US008146904B2

(12) United States Patent
Watanabe et al.

(10) Patent No.: US 8,146,904 B2
(45) Date of Patent: Apr. 3, 2012

(54) SHEET STACKING APPARATUS, SHEET PROCESSING APPARATUS, AND IMAGE FORMING APPARATUS

(75) Inventors: Kiyoshi Watanabe, Matsudo (JP); Daisaku Kamiya, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 226 days.

(21) Appl. No.: 12/277,592

(22) Filed: Nov. 25, 2008

(65) Prior Publication Data

US 2009/0134563 A1 May 28, 2009

(30) Foreign Application Priority Data

Nov. 27, 2007 (JP) ..... 2007-306541

(51) Int. Cl.
*B65H 37/04* (2006.01)

(52) U.S. Cl. ..... 270/37; 270/32; 270/45; 270/58.07; 270/58.11

(58) Field of Classification Search ..... 270/32, 270/37, 45, 58.07, 58.08, 58.09, 58.11, 58.12, 270/58.17, 58.27
See application file for complete search history.

(56) References Cited

U.S. PATENT DOCUMENTS

| | | | | |
|---|---|---|---|---|
| 5,288,062 | A * | 2/1994 | Rizzolo et al. | 270/58.12 |
| 5,382,011 | A * | 1/1995 | Tani | 270/37 |
| 6,145,825 | A | 11/2000 | Kunihiro et al. | 270/58.09 |
| 6,209,864 | B1 | 4/2001 | Taniguchi et al. | 271/220 |
| 6,712,349 | B2 * | 3/2004 | Watanabe | 270/37 |
| 6,799,759 | B1 * | 10/2004 | McNamara et al. | 270/58.08 |
| 6,994,339 | B2 | 2/2006 | Kato et al. | 270/58.12 |
| 7,007,948 | B2 | 3/2006 | Kamiya et al. | 271/221 |
| 2008/0214377 | A1 | 9/2008 | Kamiya | 493/421 |
| 2008/0224379 | A1 * | 9/2008 | McNamara | 270/58.09 |
| 2009/0127764 | A1 * | 5/2009 | Kamiya | 270/58.07 |

* cited by examiner

*Primary Examiner* — Leslie A Nicholson, III
(74) *Attorney, Agent, or Firm* — Fitzpatrick, Cella, Harper & Scinto

(57) ABSTRACT

A sheet stacking apparatus includes an alignment roller which conveys a sheet to a sheet positioning member and an opening and closing shutter which is disposed so as to face a sheet stack surface of a sheet stack guide. The sheet positioning member abuts a sheet end in a sheet conveying direction to align the sheet. The sheet is stacked on the sheet stack guide. The opening and closing shutter has a regulating area where sheet conveying guide and buckling of the sheet are regulated from an upstream side to a downstream side in the sheet conveying direction of the alignment roller. A guide interval formed between the opening and closing shutter and the sheet stack surface can be changed. Therefore, in sheet conveying positioning, the buckling can securely be prevented in the sheet stack guide.

14 Claims, 23 Drawing Sheets

SHEET STACKING APPARATUS, SHEET PROCESSING APPARATUS, AND IMAGE FORMING APPARATUS

BACKGROUND OF THE INVENTION

1. Field of the Invention

The present invention relates to a sheet stacking apparatus and a sheet processing apparatus for performing a sheet stack process and an image forming apparatus, such as a copying machine and a printer, which includes the sheet processing apparatus.

2. Description of Related Art

Conventionally, in some pieces of the image forming apparatus which forms an image on a sheet, the sheet processing apparatus which makes a bundle of sheets, in which images are formed, to perform a binding process is provided as a component of the image forming apparatus.

In the sheet processing apparatus, the sheet is sequentially received by a stack tray, the sheet is aligned by abutting a sheet end on an abutment member called trailing-end fence, and the bundle of sheets is made to perform the binding process. The stack tray is disposed with an inclination angle in order to prevent the sheet processing apparatus from enlarging.

When the stack tray is disposed with an inclination angle, a self weight easily generates buckling near the abutment member provided below the inclination, which lowers alignment performance. Particularly the buckling becomes prominent in poor fragile paper or a curled sheet. Therefore, there is a device which holds a sheet end in order to prevent the buckling of the sheet.

For example, in a technique disclosed in U.S. Pat. No. 6,145,825, a regulating pressing member is disposed between the abutment member and a brush roller which abuts the sheet end on the abutment member, and the regulating pressing member presses an upper surface of the sheet in a sheet end binding process region such that the buckling of the sheet is not generated.

However, in the case where the stack tray has the large inclination angle, possibly the buckling or wave of the sheet is generated by the self weight of the sheet when the regulating pressing member is returned from a pressing position to a home position in conveying the next sheet.

Because the sheet end is regulated and pressed only near the abutment member, the buckling or wave of the sheet is generated in other regions, a conveying defect is generated in conveying the next sheet, or an alignment defect is generated by obstructing an alignment operation.

In view of the foregoing, an object of the invention is to provide a sheet stacking apparatus, a sheet processing apparatus, and an image forming apparatus, in which the buckling of the sheet is securely prevented to improve sheet conveying performance and sheet alignment performance.

SUMMARY OF THE INVENTION

In accordance with a first aspect of the invention, a sheet stacking apparatus includes a sheet stack tray on which a sheet is stacked, provides a sheet stack surface having an inclination; a regulating member, disposed opposite a sheet stack surface of the sheet stack tray, which is movable to change a clearance between the regulating member and the sheet stack surface regulates the sheet; and a holding member which holds a sheet at an upper portion of the sheet stack tray, wherein the holding member holds the sheet after the regulating member is moved to regulate the sheet, and the regulating member is separated from the sheet after the sheet is held by the holding member.

In accordance with a second aspect of the invention, a sheet processing apparatus includes the sheet stacking apparatus of the first aspect; and a pair of folding rollers which performs a folding process to the sheet stacked on the sheet stack tray, the pair of folding rollers being disposed on a side to which the pair of folding rollers faces the sheet stack surface at a predetermined distance from the sheet stack surface, wherein the regulating member is movable in parallel to the sheet stack surface, and the regulating member is moved to a guide position at which the conveyed sheet is guided so as not to contact the pair of folding rollers.

In accordance with a third aspect of the invention, an image forming apparatus includes an image forming portion which forms an image in a sheet; and the sheet stacking apparatus of the first aspect which conveys the sheet, the image being formed in the sheet. In accordance with a fourth aspect of the invention, an image forming apparatus includes an image forming portion which forms an image in a sheet; and the sheet processing apparatus of the second aspect which processes the sheet, the image being formed in the sheet.

According to the invention, the sheet guide clearance can be narrowed in the upstream side and downstream side of the conveying roller and in the neighborhood of the abutment member, and the buckling can be prevented even in the poor fragile sheet to realize the improvement of the sheet alignment performance and the improvement of the conveying performance of the secondly conveyed sheet.

The sheet bundle can be pressed in the wide range, so that air can be removed between the sheets to prevent the wave of the sheet bundle.

The sheet guide clearance is provided after the sheet trailing end is held, so that the buckling caused by the self weight of the sheet can be prevented to improve the sheet alignment performance.

Further features of the present invention will become apparent from the following description of exemplary embodiments (with reference to the attached drawings).

DESCRIPTION OF THE EMBODIMENTS

Figure 1:
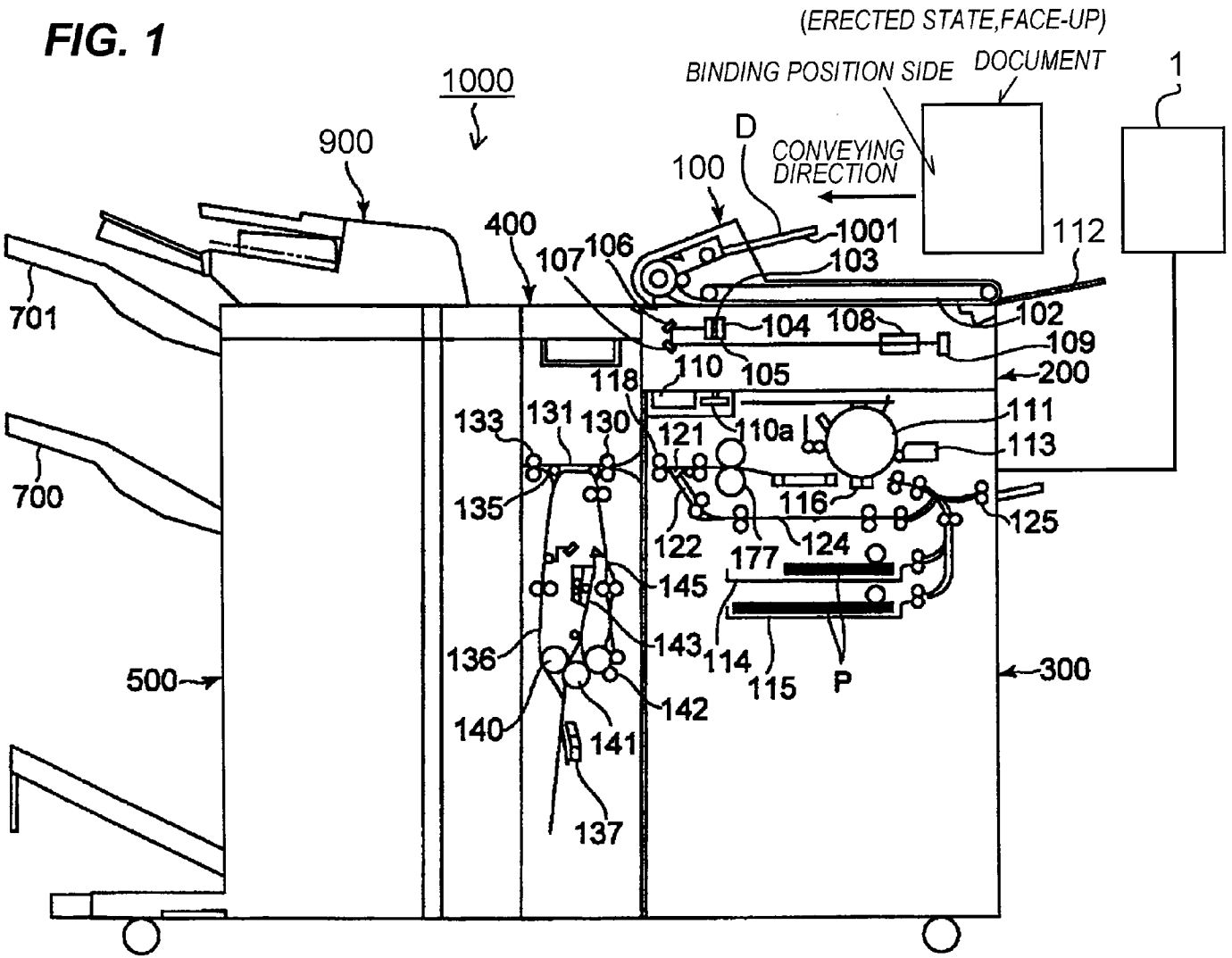
FIG. 1 illustrates a longitudinal sectional view of an image forming apparatus according to an exemplary embodiment of the invention.
Figure 2:
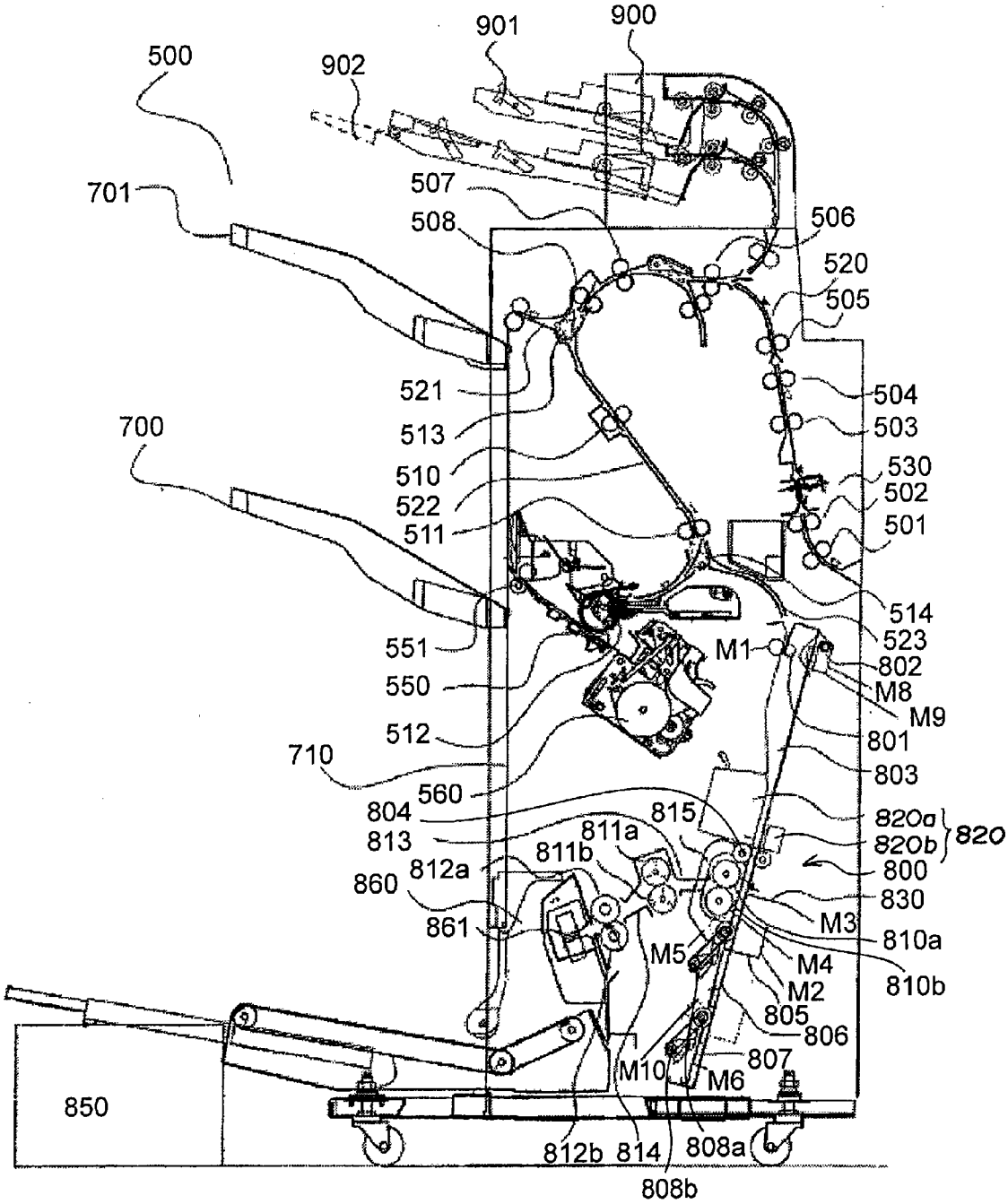
FIG. 2 illustrates a longitudinal sectional view of a sheet processing apparatus of FIG. 1.
Figure 3:
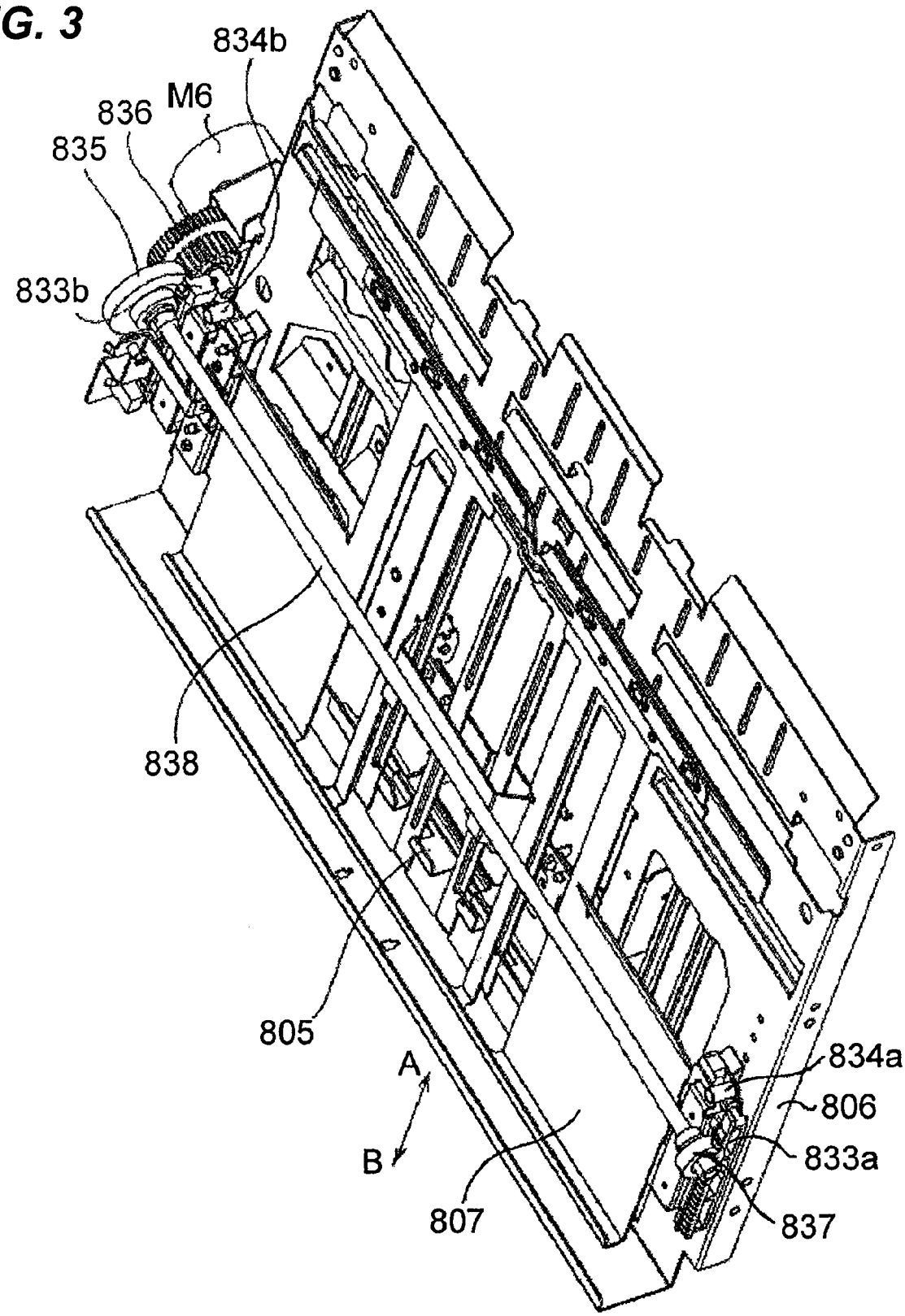
FIG. 3 illustrates a perspective view of an opening and closing shutter of FIG. 2.

An exemplary embodiment of the invention will be described in detail with reference to the drawings. FIG. 1 is a sectional view taken along a sheet conveying direction of a copying machine which is of the image forming apparatus according to an exemplary embodiment of the invention. FIG. 2 is a sectional view taken along a sheet conveying direction of a finisher which is of the sheet processing apparatus provided with a saddle stitching bookbinding portion of FIG. 1. FIG. 3 is a perspective view illustrating an opening and closing shutter of FIG. 2.

Referring to FIG. 1, an image forming apparatus 1000 includes an original feeding portion 100, an image reader portion 200, and a printer portion 300 which is of the image forming apparatus main body, a folding processing portion 400, and a finisher 500. The finisher 500 which is of the sheet processing apparatus includes a saddle stitching bookbinding portion 800 and an inserter 900.

It is assumed that an original is set in an erecting state when a user views the image forming apparatus 1000 and in a face-up state (a surface in which an image is formed is orientated upward) on a tray 1001 of the original feeding portion 100, and it is assumed that a binding position of the original is located at a left end of the original.

The original set on the tray 1001 is conveyed toward a left direction (arrow direction of FIG. 1) one by one from a front page by the original feeding portion 100, that is, the original is conveyed while the binding position is set to a leading position. The original is conveyed from the left to the right on a platen glass 102 through a curved path, and the original is discharged onto a discharge tray 112.

At this point, a scanner unit 104 is retained at a predetermined position, and the original passes through the scanner unit 104 from the left to the right, whereby performing a reading process. Hereinafter, this reading method is referred to as original passing reading.

When the original passes through the platen glass 102, a lamp 103 of the scanner unit 104 irradiates the original with light, and the light reflected from the original is guided to an image sensor 109 through mirrors 105, 106, and 107 and a lens 108.

Alternatively, the original conveyed by the original feeding portion 100 is tentatively stopped on the platen glass 102, and the scanner unit 104 may be moved from the left to the right to perform the original reading process. Hereinafter, this reading method is referred to as original fixed reading.

In the case where the original is read without using the original feeding portion 100, a user lifts the original feeding portion 100 to set the original on the platen glass 102. At this point, the original fixed reading is performed.

Predetermined image processing is performed to original image data read by the image sensor 109, and the original image data is transmitted to an exposure controlling portion 110. The exposure controlling portion 110 supplies a laser beam according to an image signal. A photosensitive drum 111 is irradiated with the laser beam while the laser beam is scanned by a polygon mirror 110*a*. An electrostatic latent image is formed on the photosensitive drum 111 according to the scanned laser beam.

The electrostatic latent image formed on the photosensitive drum 111 is developed into a visualized toner image by a development device 113. The photosensitive drum 111 and the development device 113 constitute the image forming portion. On the other hand, a sheet P such as a recording sheet is conveyed to a transfer portion 116 from one of cassettes 114 and 115, manual feeding portion 125, and a duplex conveying path 124. The visualized toner image is transferred to the sheet P by the transfer portion 116. Then, a fixing portion 177 performs a fixing process to the sheet P.

A switching member 121 tentatively guides the sheet P passing through the fixing portion 177 to a path 122, and switchback is performed after a trailing end of the sheet P passes through the switching member 121. Then, the switching member 121 conveys the sheet P to a discharge roller 118.

The discharge roller 118 discharges the sheet P from the printer portion 300. At this point, the sheet P is discharged from the printer portion 300 while the surface in which the toner image is formed faces a downward direction (in a face-down state) Hereinafter, this is referred to as reversal discharge.

The image forming process is sequentially performed from the front page while the sheet P in the face-down state is discharged to the outside. In this case, the page order can be aligned in the case where the image forming process is performed with the original feeding portion 100 or in the case where the image forming process is performed to the image data transmitted from a computer.

In the case where the image forming process is performed to the hard sheet P such as an OHP sheet conveyed from the manual feeding portion 125, the discharge roller 118 discharges the sheet P from the printer portion 300 without guiding the sheet P to the path 122 while the surface in which the toner image is formed faces the upward direction (in the face-up state).

In the case where image forming process is performed both surfaces of the sheet P, the sheet P is directly guided from the fixing portion 177 toward the discharge roller 118, the switchback is performed immediately after the trailing end of the sheet P passes through the switching member 121, and the switching member 121 guides the sheet P to a duplex conveying path 124.

Then, configurations of the folding processing portion 400 and the finisher 500 will be described with reference to FIGS. 1 and 2.

The folding processing portion 400 includes a conveying path 131. The sheet P discharged from the printer portion 300 is introduced to the conveying path 131, and the sheet P is guided onto the side of the finisher 500 through the conveying path 131. A pair of conveying rollers 130 and a pair of discharge rollers 133 are provided on the conveying path 131. A switching member 135 provided near the pair of discharge rollers 133 guides the sheet P, conveyed by a pair of conveying rollers 130, onto the side of a folding path 136 or the side of the finisher 500.

In the case where a process of folding the sheet P is performed, the switching member 135 is switched onto the side of the folding path 136 to guide the sheet P to the folding path 136. The sheet P guided to the folding path 136 is conveyed to a folding roller 140 and folded into a Z-shape. On the other hand, in the case where the process of folding the sheet P is not performed, the switching member 135 is switched onto the side of the finisher 500, and the sheet P discharged from the printer portion 300 is directly delivered through the conveying path 131.

The sheet P conveyed through the folding path 136 is abutted on a stopper 137 to form a loop, and the loop is folded by folding rollers 140 and 141. The folded portion is abutted on an upper stopper 143 to form a partial loop, and the partial loop is further folded by folding rollers 141 and 142, thereby forming a Z-folded sheet P.

The Z-folded sheet P is delivered to the conveying path 131 through a conveying path 145, and the pair of discharge rollers 133 discharge the sheet P to the finisher 500 provided on the downstream side. The folding processing operation performed by the folding processing portion 400 is selectively performed.

The finisher 500 takes in the sheet P, conveyed through the folding processing portion 400, from the printer portion 300. The finisher 500 aligns the plural taken-in sheets P to selectively perform one of a process for bundling the sheets P in one sheet bundle, a stapling process (binding process) for stapling a trailing end side of the sheet bundle, a sorting process, and a non-sorting process.

As illustrated in FIG. 2, the finisher 500 includes a conveying path 520 which is used to take the sheet P, conveyed through the folding processing portion 400, in the inside of the apparatus. In the conveying path 520, pairs of conveying rollers 502 to 508 are sequentially provided from a pair of entrance rollers 501 toward the downstream side in the sheet conveying direction.

A punch unit 530 is provided between the pair of conveying rollers 502 and the pair of conveying rollers 503.

The punch unit 530 performs a process for punching the trailing end of the conveyed sheet P if needed.

A switching member 513 is provided at a termination of the conveying path 520. The switching member 513 switches the path between an upper discharge path 521 and a lower discharge path 522, which are connected to the downstream side of the switching member 513. The upper discharge path 521 discharges the sheet P to an upper stack tray 701.

On the other hand, pairs of conveying rollers 510, 511, and 512 are provided in the lower discharge path 522. The pairs of conveying rollers 510, 511, and 512 convey and discharge the sheet P to a processing tray 550.

The sheets P discharged to the processing tray 550 are stored in the bundle shape while an alignment process is sequentially to the sheets P. The sorting processor the stapling processing is selectively performed according to a setting from an operation portion 1, and the sheets P are discharged to stack trays 700 and 701 by a pair of bundle discharge rollers 551.

The stapling process is performed by a stapler 560. The stapler 560 can be moved in a width direction orthogonal to a conveying direction of the sheet P, and the stapler 560 can staple the sheets P at any position.

The stack trays 700 and 701 can be moved in a vertical direction. The upper stack tray 701 can receive the sheets P from the upper discharge path 521 and the processing tray 550. The lower stack tray 700 can receive the sheets P from the processing tray 550.

Thus, a large amount of sheets P can be stacked on the stack trays 700 and 701, and the trailing ends of the stacked sheets P are regulated and aligned by a vertically extended trailing-end guide 710.

In the saddle stitching bookbinding portion 800 which is of the sheet stacking apparatus, a process for folding the sheet bundle with a pair of folding rollers 810*a* and 810*b* and an ejection plate 830 which are of the sheet processing portion is referred to as folding process. A process for making a folding line in the sheet bundle to which the folding process is already performed with pair of press rollers 861 is referred to as folding-line strengthen process.

The saddle stitching bookbinding portion 800 includes a pair of press rollers 861. A switching member 514 is provided in the middle of the lower discharge path 522, and the sheet P is guided to the processing tray 550 or a saddle discharge path 523 through the lower discharge path 522. The sheet P guided to the saddle discharge path 523 by the switching member 514 is delivered to the saddle stitching bookbinding portion 800.

A pair of saddle entrance rollers 801, a sheet trailing-end sorting member 802, and a sheet storage guide 803 are sequentially provided from an entrance of the saddle stitching bookbinding portion 800. A sheet stack guide 806, a sliding roller 804, and a sheet positioning member (abutment member) 805 are sequentially provided from the sheet storage guide 803. The sheet storage guide 803 and the sheet stack guide 806 constitute the sheet stack tray. An opening and closing shutter 807 and alignment rollers 808a and 808b are provided opposite the sheet stack guide 806. The opening and closing shutter 807 is of a regulating member which guides the conveyance of the sheet P and regulates the buckling of the sheet P. The alignment rollers 808*a* and 808*b* are of the sheet conveying member. The sheet storage guide 803 and the sheet stack guide 806 provides an inclined sheet stack surface, the sheet positioning member 805 is provided at a lower portion of the sheet stack guide 806, and the sheet trailing-end sorting member 802 is provided at an upper portion of the sheet storage guide 803. The sheet trailing-end sorting member 802 holds an upper portion of a sheet stacked on the sheet storage guide 803.

The pair of saddle entrance rollers 801 and the sliding roller 804 are rotated by a motor M1. A stapler 820 is provided in the middle of the sheet storage guide 803, and the stapler 820 is disposed while sandwiching the sheet storage guide 803. The stapler 820 includes a driver 820*a* which ejects a staple and an anvil 820*b* which folds the ejected staple.

The sheet trailing-end sorting member 802 can be rotated by a motor M8, and the sheet trailing-end sorting member 802 presses the trailing end of the sheet P conveyed to the sheet storage guide 803. The sheet trailing-end sorting member 802 is elevated and lowered by a motor M9, and the sheet trailing-end sorting member 802 is stopped at a position corresponding to a sheet size.

The sheet positioning member 805 receives a sheet leading end (lower end) in conveying the sheet P, and the sheet positioning member 805 can be elevated and lowered to adjust a position thereof such that a central portion in the sheet conveying direction becomes a binding position of the stapler 820. The sheet positioning member 805 is elevated and lowered by a motor M2, and the sheet positioning member 805 is stopped at a position corresponding to the sheet size.

The pair of folding rollers 810*a* and 810*b* is provided on the downstream side of the stapler 820. An ejection plate 830 is provided opposite the pair of folding rollers 810*a* and 810*b*. The pair of folding rollers 810*a* and 810*b* and the ejection plate 830 constitute the folding portion.

In conveying the sheet P, the opening and closing shutter 807 is located at a position, where the sheet P is guided so as not to contact the pair of folding rollers 810*a* and 810*b*. In folding the sheet P, the opening and closing shutter 807 is located at a position, where an ejection path is opened such that the ejection plate 830 is ejected toward the pair of folding rollers 810*a* and 810*b*. In this case, the opening and closing shutter 807 is reciprocally moved in the sheet conveying direction by a motor M6. The opening and closing shutter 807 has a conveying guide region and a regulating region from the upstream side to the downstream side in the sheet conveying direction of the alignment rollers 808*a* and 808*b*. The conveyance of the sheet P is guided in the conveying guide region, and the buckling of the sheet P is regulated in the regulating region.

As illustrated in FIG. 3, racks 833*a* and 833*b* are provided in the opening and closing shutter 807. A torque of a motor M6 is transmitted to the rack 833*b* through two gears 836 and 835, and the torque is transmitted from a shaft 838 coupled to the gear 835 to the rack 833*a* through a gear 837. Therefore, the opening and closing shutter 807 is reciprocally moved in A and B directions of FIG. 3.

Both the reciprocating operation in the sheet conveying direction and the guide clearance changing operation of the opening and closing shutter 807 are performed by the identical motor M6, and the gears 833*a* and 833*b* provided in the opening and closing shutter 807 are always biased by springs 834*a* and 834*b* so as to engage the gears 835 and gear 837, respectively.

Figure 4:
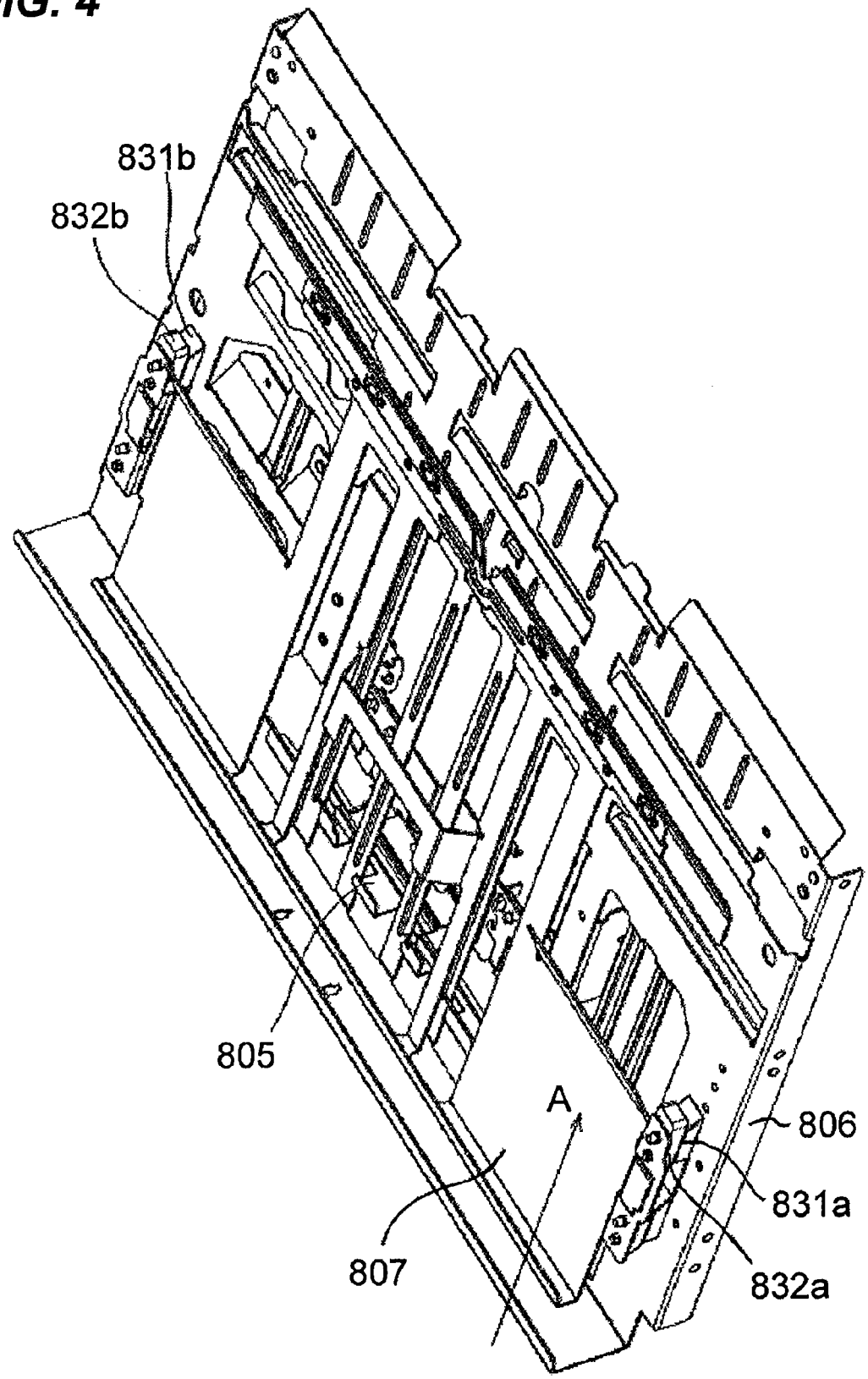
FIG. 4 illustrates a perspective view of the opening and closing shutter of FIG. 2.

Referring to FIG. 4, guide members 832*a* and 832*b* are fixed to the opening and closing shutter 807, and guide members 831*a* and 831*b* are fixed to the sheet stack guide 806. The guide members 831*a*, 831*b*, 832*a*, and 832*b* guide the opening and closing shutter 807 such that the opening and closing shutter 807 is moved in parallel to the sheet stack guide 806. A nip of the pair of folding rollers 810*a* and 810*b* is covered with the opening and closing shutter 807 when the opening and closing shutter 807 is moved to a guide position at which the sheet P to be stacked is guided, and the sheet P is stacked in a space formed by the opening and closing shutter 807 and the sheet stack surface of the sheet stack guide 806.

Figure 5:
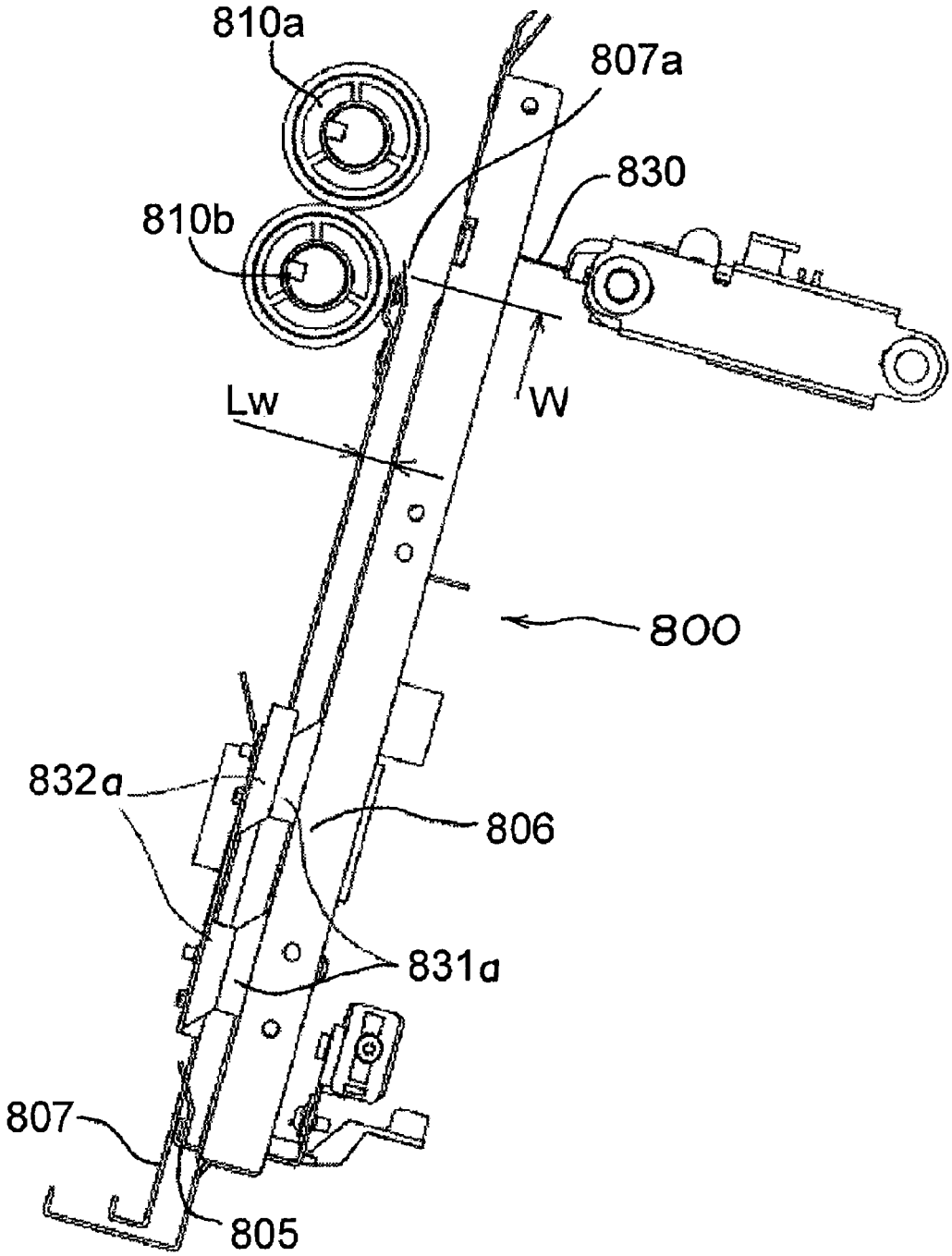
FIG. 5 illustrates a front view of the opening and closing shutter and a pair of folding rollers of FIG. 2.

FIG. 5 illustrates the state in which the ejection plate 830 is ejected toward the pair of folding rollers 810*a* and 810*b*. At this point, a leading end 807*a* of the opening and closing shutter 807 is located at a position W of FIG. 5, and the guide clearance becomes Lw. For example, Lw is set to 7 mm.

Figure 6:
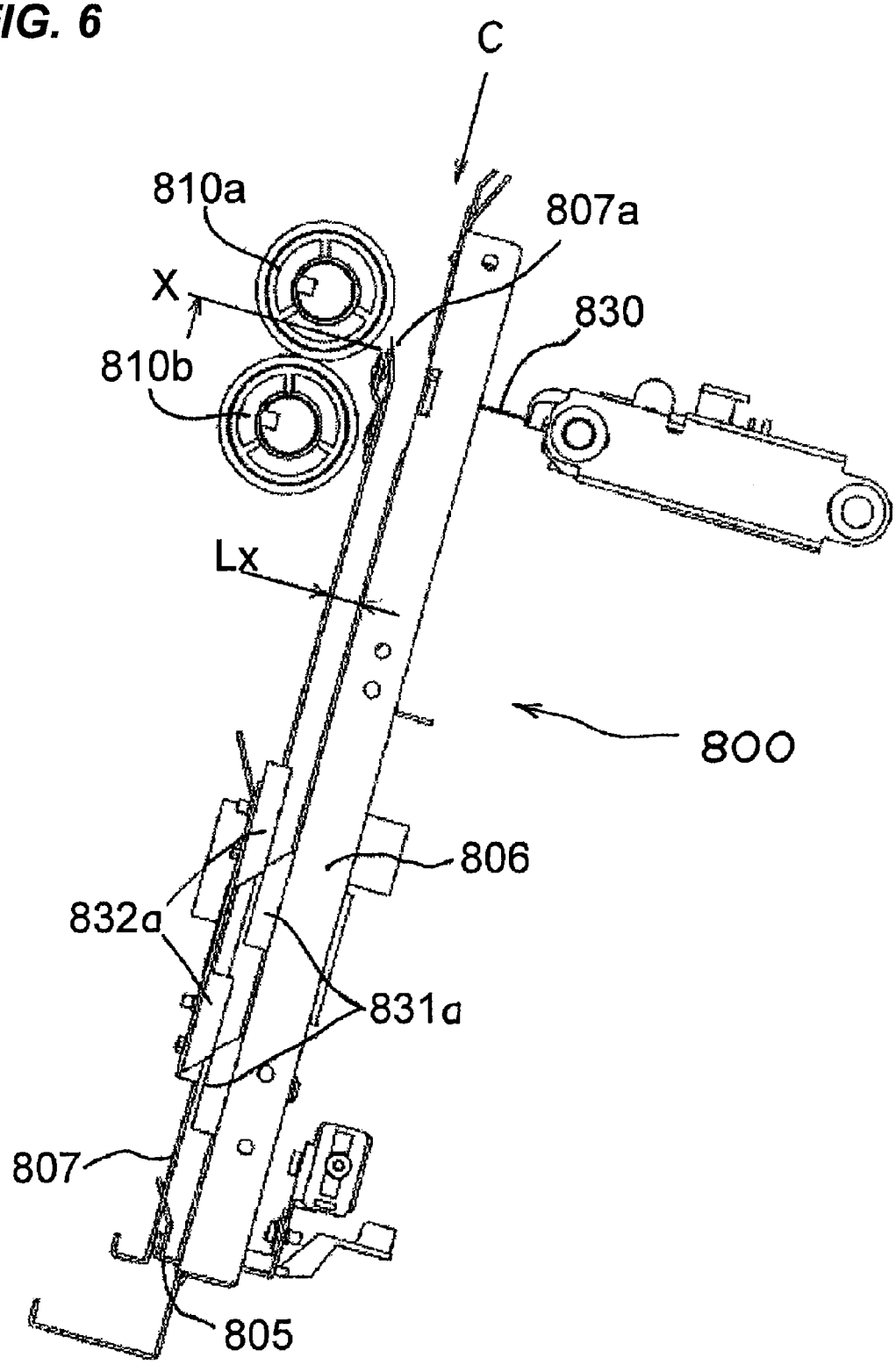
FIG. 6 illustrates a front view of the opening and closing shutter and the pair of folding rollers of FIG. 2.

FIG. 6 illustrates the state the nip of the pair of folding rollers 810*a* and 810*b* is covered with the opening and closing shutter 807, and the opening and closing shutter 807 guides the sheet P conveyed from a C direction of FIG. 6 such that the sheet P does not contact the pair of folding rollers 810*a* and 810*b*. At this point, the leading end 807*a* of the opening and closing shutter 807 is located at a position X of FIG. 6, and the guide clearance becomes Lx. For example, Lx is set to 7 mm.

Figure 7:
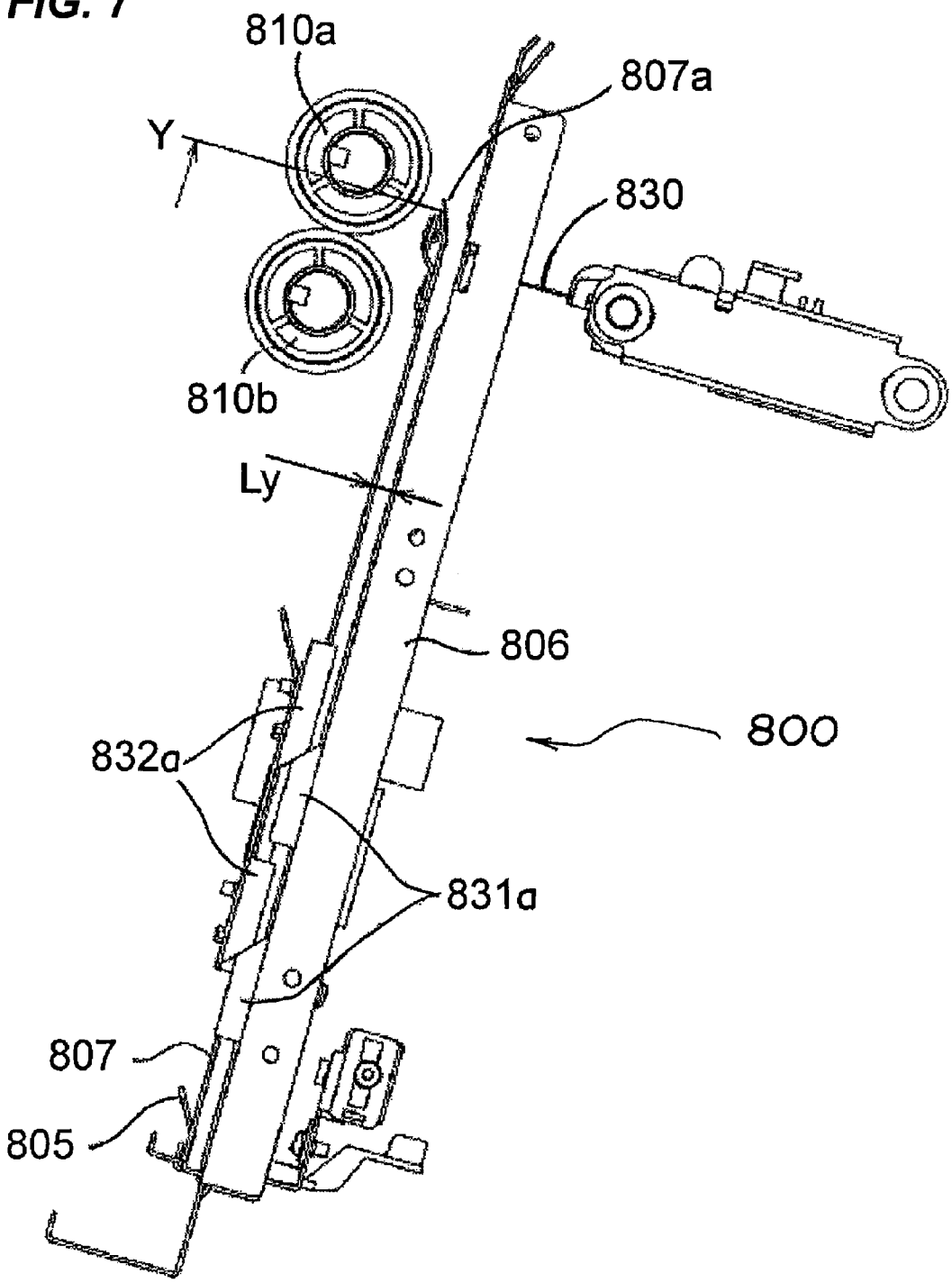
FIG. 7 illustrates a front view of the opening and closing shutter and the pair of folding rollers of FIG. 2.

FIG. 7 illustrates the state in which the opening and closing shutter 807 is moved toward a direction of the sheet stack guide 806 to narrow the guide clearance. At this point, the leading end 807*a* of the opening and closing shutter 807 is located at a position Y of FIG. 7, and the guide clearance becomes Ly.

Figure 8:
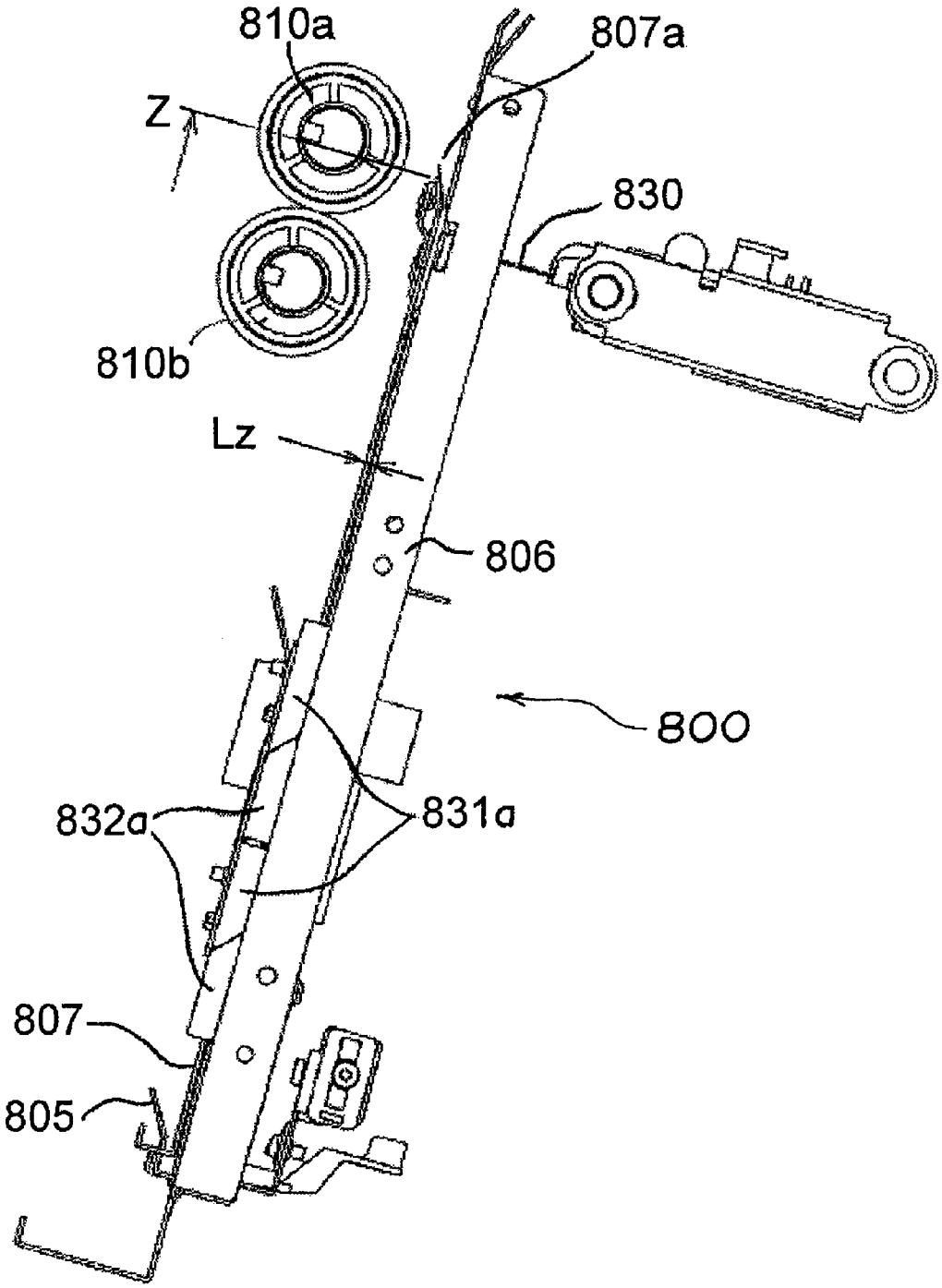
FIG. 8 illustrates a front view of the opening and closing shutter and the pair of folding rollers of FIG. 2.

FIG. 8 illustrates the state in which the opening and closing shutter 807 contacts the sheet stack guide 806. At this point, the leading end 807*a* of the opening and closing shutter 807 is located at a position Z of FIG. 8, and the guide clearance becomes Lz. The guide clearance Lz is changed according to a thickness of the stacked sheet bundle by the springs 834*a* and 834*b* of FIG. 3.

As illustrated in FIGS. 5 to 8, the opening and closing shutter 807 is moved from the position W to the position Z by the motor M6. Therefore, a slope provided in the guide members 832*a* and 832*b* is slid on a slope provided in the guide members 831*a* and 831*b*, thereby changing the guide clearances (Lw, Lx, Ly, and Lz).

The guide clearances are set to proper values at the positions X to Z according to the thickness of the stacked sheets P (the number of stacked sheets) or the thickness of the conveyed sheet P, and the conveyed sheets P are guided so as not to contact the pair of folding rollers 810*a* and 810*b*. That is, the positions Lx, Ly, and Lz where the nip of the pair of folding rollers 810*a* and 810*b* is covered with the opening and closing shutter 807 are defined by the thickness of the stacked sheets P (the number of stacked sheets P) or the thickness of the conveyed sheet P. The positions Lx, Ly, and Lz are set within predetermined regions (positions X to Z) where the sheet P can be guided so as not to contact the pair of folding rollers 810*a* and 810*b*. The position W is set within a region where the opening and closing shutter 807 can open the ejection path of the ejection plate 830 such that the ejection plate 830 is ejected toward the pair of folding rollers 810*a* and 810*b*.

Figure 9:
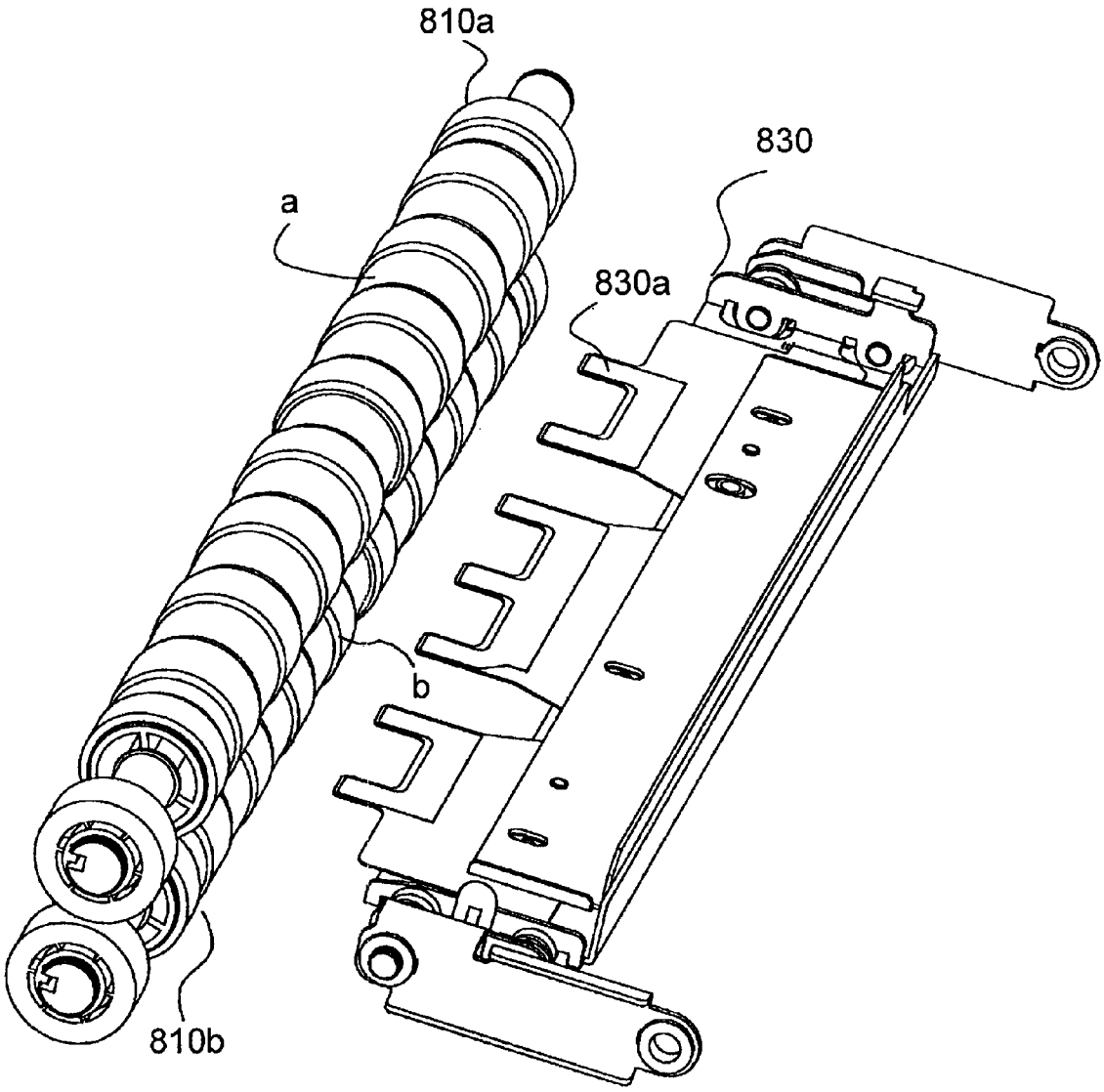
FIG. 9 illustrates a perspective view of a folding unit portion.

As illustrated in FIG. 9, the pair of folding rollers 810*a* and 810*b* is a pair of skewer-shaped rollers. The pair of folding rollers 810*a* and 810*b* have at least one recess a and at least one recess b, respectively. The leading end of the ejection plate 830 is formed into a shape having at least one projection 830*a* which can be projected and retracted into and from the position corresponding to the recesses a and b.

Therefore, the ejection plate 830 is easily projected and retracted into and from the nip of the pair of folding rollers 810*a* and 810*b*. That is, the ejection plate 830 is inserted into the nip of the pair of folding rollers 810*a* and 810*b*, and the folded portion of the sheet bundle is securely nipped in each bundle.

Accordingly, a phenomenon that only the front cover is taken in by the pair of folding rollers 810*a* and 810*b* to peel-off the front cover from the sheet bundle can be prevented in the case where the sheet P having a low friction coefficient is used as a front cover like the sheet Pin which a color image is printed.

Additionally, damage to the image caused by a scratch of the inside sheet P on the ejection plate 830 can be reduced when the ejection plate 830 enters and leaves into and from the nip of the pair of folding rollers 810*a* and 810*b*.

In the ejection plate 830, a position at which the ejection plate 830 is retracted from the sheet storage guide 803 is set at a home position. The ejection plate 830 is ejected toward the stored sheet bundle by a motor M3, the ejection plate 830 tucks the sheet bundle in the nip of the pair of folding rollers 810*a* and 810*b*, and the ejection plate 830 is returned to the home position. A force enough to perform the folding process for folding the sheet bundle is applied between the pair of folding rollers 810*a* and 810*b* by a spring (not illustrated)

The sheet bundle folded by the pair of folding rollers 810*a* and 810*b* is discharged onto a folded sheet bundle tray 850 through a first pair of folding and conveying rollers 811*a* and 811*b* and a second pair of folding and conveying rollers 812*a* and 812*b*. Forces enough to convey and stop the folded sheet bundle are applied between the first pair of folding and conveying rollers 811*a* and 811*b* and between the second pair of folding and conveying rollers 812*a* and 812*b*.

A conveying guide 813 guides the sheet bundle between the pair of folding rollers 810*a* and 810*b* and the first pair of folding and conveying rollers 811*a* and 811*b*. A conveying guide 814 guides the sheet bundle between the first pair of folding and conveying rollers 811*a* and 811*b* and the second pair of folding and conveying rollers 812*a* and 812*b*.

The pair of folding rollers 810*a* and 810*b*, the first pair of folding and conveying rollers 811*a* and 811*b*, and the second pair of folding and conveying rollers 812*a* and 812*b* are rotated at a constant speed by the same motor M4 while nipping the saddle-stitched sheet bundle from both surfaces.

The sheet positioning member 805 lowers the sheet bundle from the position in performing the stapling process by a predetermined distance, and the stapling position of the sheet bundle is matched with the nip position of the pair of folding rollers 810*a* and 810*b*. Then, the sheet bundle stapled by the stapler 820 is folded. Accordingly, the sheet bundle is folded while centering around the portion to which the stapling process is performed (bound portion).

A pair of alignment plates 815 has a surface which is projected to the sheet storage guide 803 while surrounding an outer circumferential surface of the pair of folding rollers 810*a* and 810*b*, and the pair of alignment plates 815 aligns a width of the sheet P stored in the sheet storage guide 803.

The pair of alignment plates 815 is moved in a direction in which the sheet P is sandwiched between pair of alignment plates 815 by a motor M5, thereby performing the positioning (alignment) in the width direction of the sheet P.

Alignment rollers 808*a* and 808*b* are rotated by a motor M10 to convey the sheet P, conveyed to the sheet storage guide 803, to the sheet positioning member 805. In conveying the sheet P, the alignment rollers 808*a* and 808*b* is brought into contact with the sheet stack surface or the sheet surface by a drive source (not illustrated). In positioning (aligning) the sheet P in the sheet width direction, the alignment rollers 808*a* and 808*b* are separated from the sheet surface.

Because the opening and closing shutter 807 is provided on the upstream and downstream side of the alignment rollers 808*a* and 808*b*, a proper guide clearance is formed according to the thickness of the stacked sheet bundle or the thickness of the conveyed sheets. Therefore, the sheet P conveyed by the alignment rollers 808*a* and 808*b* does not contact the opening and closing shutter 807, which prevents such a conveying defect that the sheet P invades in lower surfaces of the alignment roller 808*a* and 808*b*. The opening and closing shutter 807 has a region where the sheet P is regulated from the upstream side to the downstream side in the sheet conveying direction by the alignment roller 808*a* and 808*b*.

A folding-line press unit 860 which is of the folded portion processing unit is provided on the downstream side of the second pair of folding and conveying rollers 812*a* and 812*b*. The folding-line press unit 860 includes a press holder (not illustrated) which supports a pair of press rollers 861. The folding-line press unit 860 moves the press holder in the folding-line direction while a pair of press rollers 861 nips the folded portion, which strengthening the folding line.

The inserter 900 is provided above the finisher 500, and the inserter 900 inserts a sheet (insert sheet) which is different from the usual sheet into a front page, a final page, or a mid-page of the sheets P. That is, the inserter 900 inserts the insert sheet or a sheet for the front cover into the sheets in which the images are formed by the printer portion 300.

The inserter 900 feeds the sheet P set in insert trays 901 and 902 by the user to one of the stack trays 701 and 700 and the folded sheet bundle tray 850 without passing the sheet P through the printer portion 300. The sheet bundle stacked on the insert trays 901 and 902 is separated one by one to join the conveying path 520 at desired timing.

Figure 10:
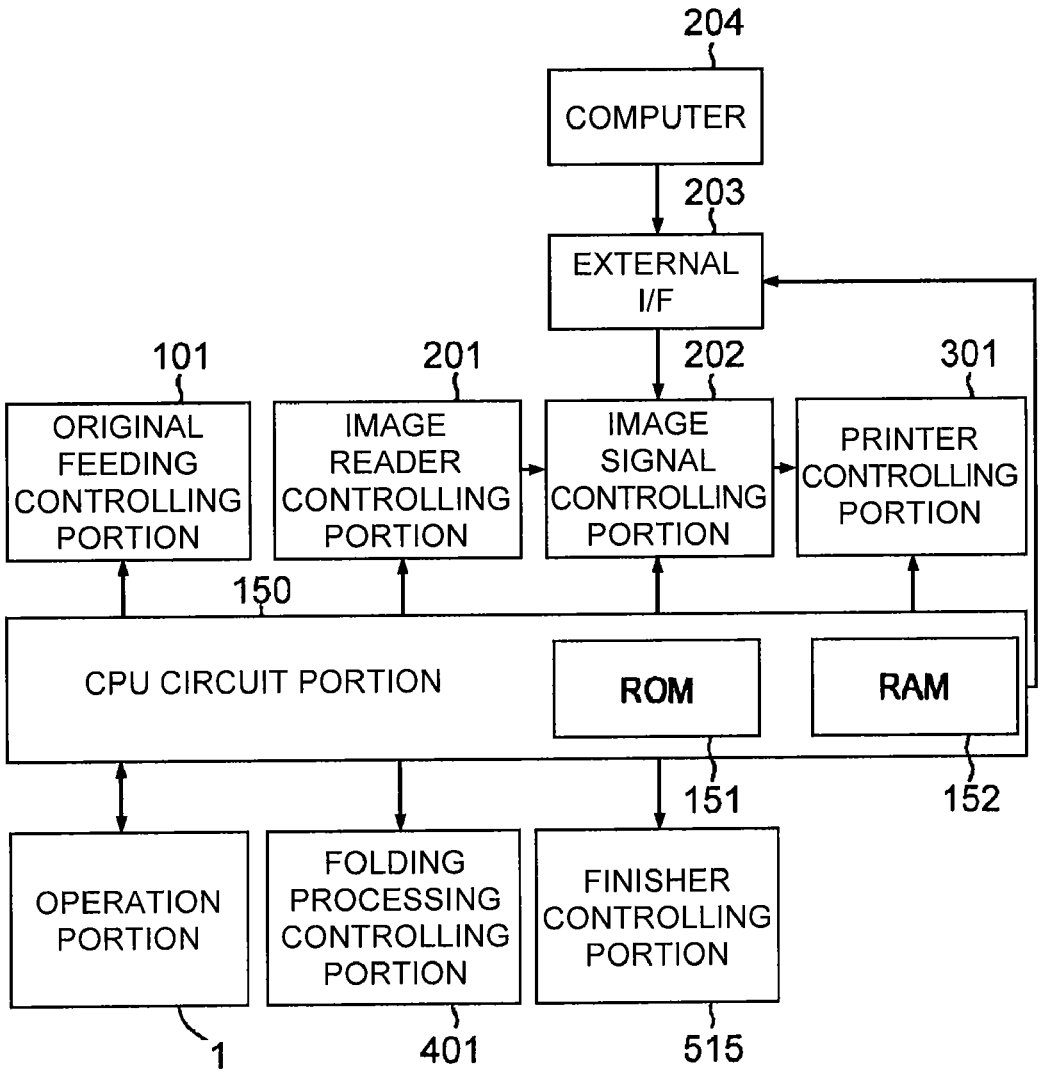
FIG. 10 illustrates a control block diagram of the whole of the image forming apparatus.

FIG. 10 illustrates a control block diagram of the image forming apparatus 1000. A CPU circuit portion 150 includes CPU (not illustrated). The CPU circuit portion 150 controls an original feeding controlling portion 101 and an image reader controlling portion 201 based on a control program stored in ROM 151 and the setting of the operation portion 1. The CPU circuit portion 150 also controls an image signal controlling portion 202, a printer controlling portion 301, a folding processing controlling portion 401, a finisher controlling portion 515, and an external I/F 203.

The original feeding controlling portion 101 controls the original feeding portion 100, and the image reader controlling portion 201 controls the image reader portion 200. The printer controlling portion 301 controls the printer portion 300, and the folding processing controlling portion 401 controls the folding processing portion 400.

The finisher controlling portion 515 controls the finisher 500, the saddle stitching bookbinding portion 800, and the inserter 900. The operation portion 1 includes plural keys which are used to set various functions for the image formation and a display portion which displays a setting state.

A type (such as plain paper, coated paper, and special paper) of the sheet, sheet information on the sheet size, and conditions are fed from an operation panel of the image forming apparatus main body by a user's operation. The CPU circuit portion 150 can obtain and recognize the sheet conditions.

In addition to the sheet size, examples of the sheet conditions include physical properties (surface characteristics) such as rigidity, thickness, grammage, surface resistance, and surface smoothness and a kind of the sheet such as punch paper and tub paper. The operation portion 1 supplies a key signal corresponding to each key operation performed by the user to the CPU circuit portion 150, and the operation portion 1 causes the display portion to display corresponding information based on a signal supplied from the CPU circuit portion 150.

RAM 152 is used as an area where control data is temporarily stored or a computation working area associated with the control. The external I/F 203 is an interface between the image forming apparatus 1000 and an external computer 204, the external I/F 203 expands print data supplied from the computer 204 into an bitmap image, and the external I/F 203 supplies the bitmap image in the form of image data to the image signal controlling portion 202.

The image reader controlling portion 201 supplies an image of the original read by an image sensor (not illustrated) to the image signal controlling portion 202. The printer controlling portion 301 supplies the image data, supplied from the image signal controlling portion 202, to an exposure controlling portion (not illustrated).

Although the configuration in which the finisher controlling portion 515 is mounted on the finisher 500 is described in the embodiment, the invention is not limited to the configuration of the embodiment. Alternatively, the printer portion 300 is provided while integrated with the CPU circuit portion 150, and the finisher 500 maybe controlled from the side of the printer portion 300.

Figure 11:
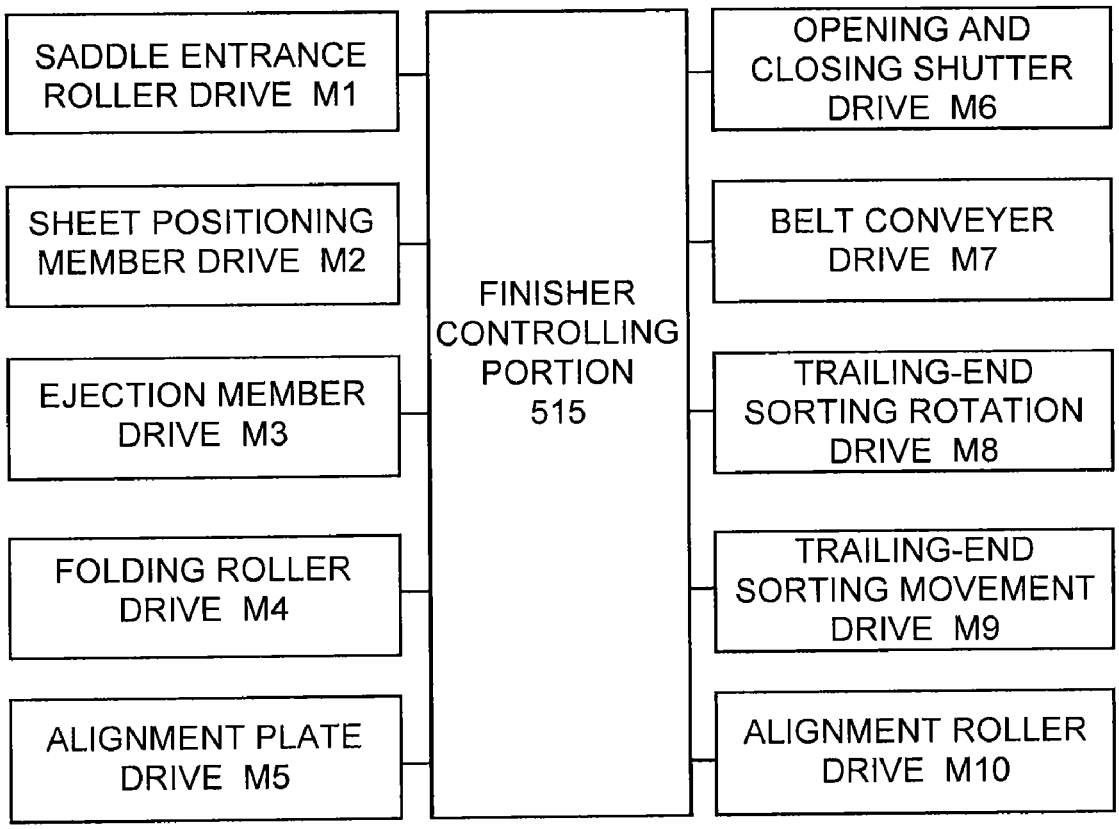
FIG. 11 illustrates a block diagram of a finisher controlling portion.

FIG. 11 illustrates a block diagram of the finisher controlling portion 515. The finisher controlling portion 515 controls drive motors M1 to M10.

A saddle stitching bookbinding operation performed by the saddle stitching bookbinding portion 800 will be described with reference to flowcharts of FIGS. 12 and 13.

<In the Case of Thin Sheet>

Figure 12:
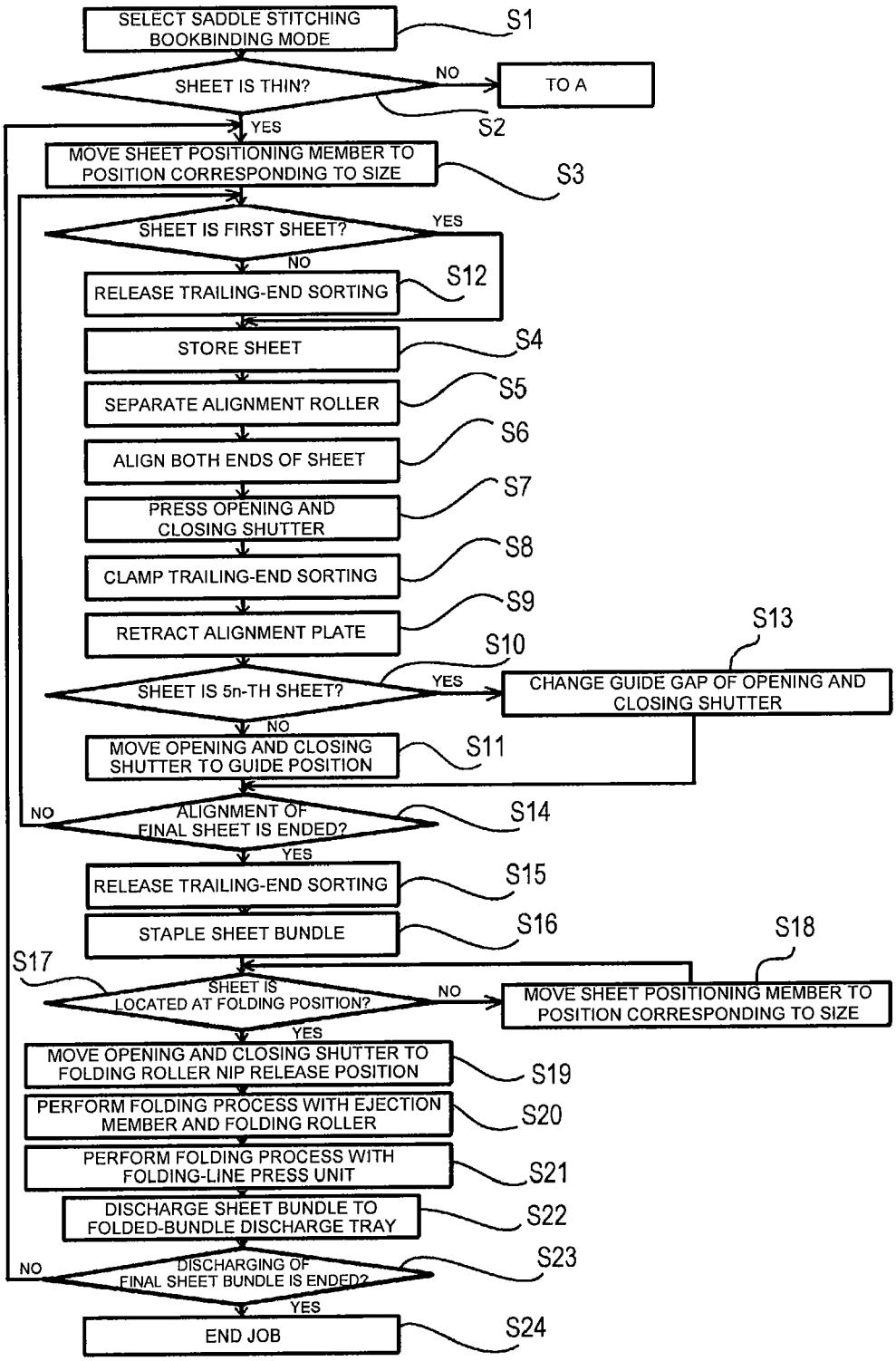
FIG. 12 illustrates a flowchart of a saddle stitching bookbinding operation performed by a saddle stitching bookbinding portion.

Referring to FIG. 12, when the user sets a saddle stitching bookbinding mode in which the thin sheet is used (Steps S1 and S2), the sheet positioning member 805 is moved to the position corresponding to the set sheet size (Step S3).

The opening and closing shutter 807 is moved to the position at which the sheet P is guided to the nip of the pair of folding rollers 810*a* and 810*b*. The sheet P in which the image is formed is sequentially discharged from the discharge roller 118 of the printer portion 300. The sheet P passes through the folding processing portion 400 and the sheet P is received by the pair of entrance rollers 501. Then, the sheet P is delivered to the lower discharge path 522 through the conveying path 520.

The sheet P is switched to the right by the switching member 514 provided in the middle of the lower discharge path 522, and the sheet P is delivered to the sheet saddle stitching bookbinding portion 800 through the saddle discharge path 523.

The sheet P is transferred to the pair of saddle entrance rollers 801 as the conveying portion, and the sheet P is brought in the sheet storage guide 803 of the saddle stitching bookbinding portion 800. The sheet P is abutted on the sheet positioning member 805 while conveying forces of the sliding roller 804 and alignment roller 808 are applied to the sheet P (Step S4). The sheet positioning member 805 is previously stopped at the position suitable to the sheet size in Step S3. Therefore, the positioning of the sheet P is performed in the sheet conveying direction.

At this point, the opening and closing shutter 807 is located at the position where the conveyed sheet P is guided so as not to contact the pair of folding rollers 810*a* and 810*b*. In the case of the thin sheet, the guide clearance between the opening and closing shutter 807 and the sheet stack guide 806 is narrowed (for example, the guide clearance is set to 2 mm, see FIG. 7) to eliminate the space where the buckling of the sheet P is generated.

Figure 14:
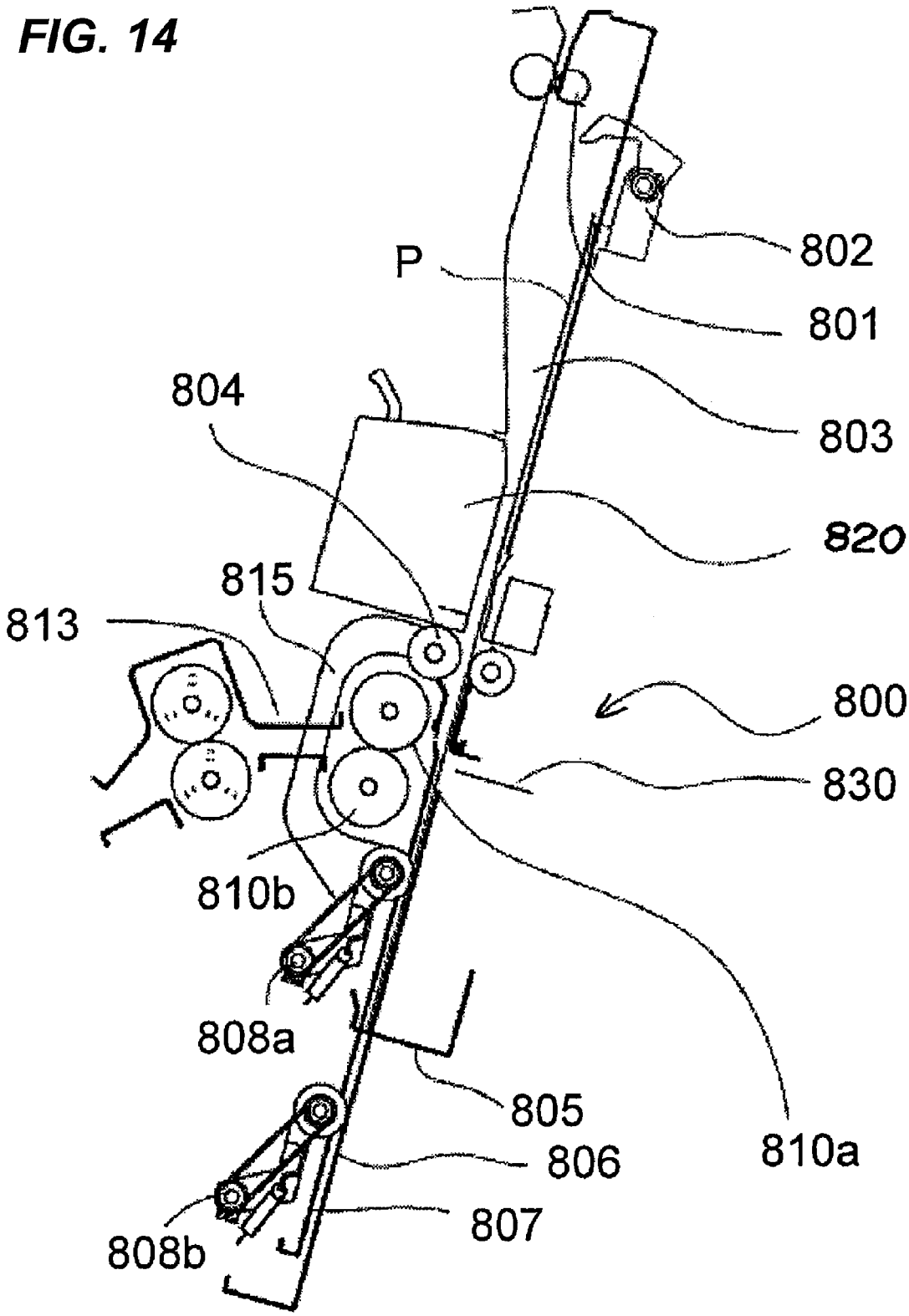
FIG. 14 illustrates a flow of a sheet in the saddle stitching bookbinding portion.

The alignment roller 808 is separated (Step S5), and the sheet P is sandwiched and aligned by the pair of alignment plates 815 which is retracted to the waiting position at which the pair of alignment plates 815 do not obstruct the sheet P in delivering the sheet P to the sheet storage guide 803, thereby aligning both side ends of the sheet (Step S6). Accordingly, as illustrated in FIG. 14, the lower end and both side ends are aligned in the sheet P.

The opening and closing shutter 807 is moved to the pressing position, and the sheet P is pressed while sandwiched between the opening and closing shutter 807 and the sheet stack guide 806 (Step S7). At this point, the pair of alignment plates 815 is located at the alignment position such that the sheet P is not shifted in the width direction.

Figure 15:
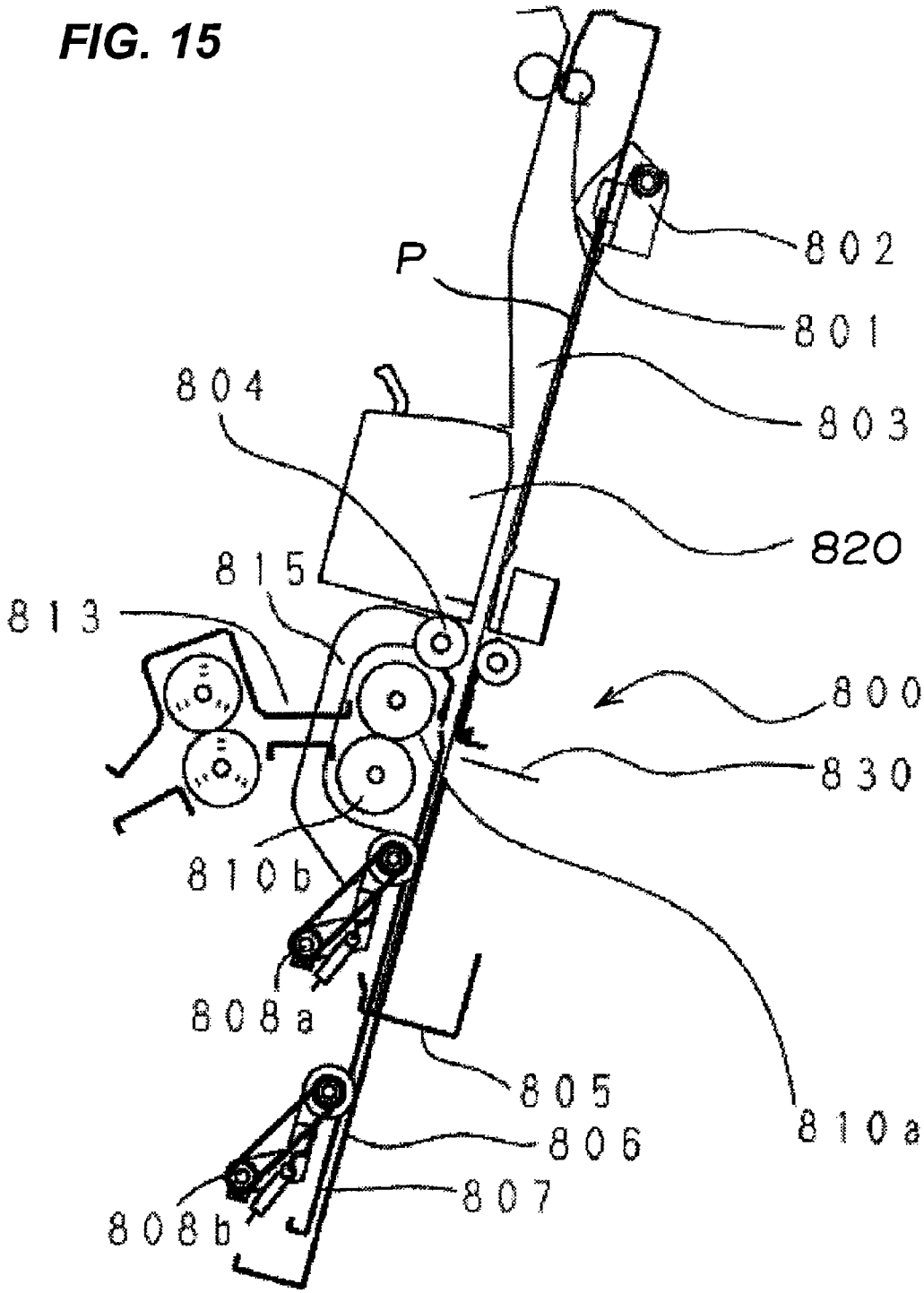
FIG. 15 illustrates the flow of the sheet in the saddle stitching bookbinding portion.

As illustrated in FIG. 15, the sheet trailing-end sorting member 802 which is of the holding member clamps the sheet trailing end (Step S8), thereby fixing the sheet position. The pair of alignment plates 815 is returned to the waiting position (Step S9), the opening and closing shutter 807 is returned to the guide position (Step S11), and the pair of alignment plates 815 and the opening and closing shutter 807 wait for the conveyance of the next sheet P.

Figure 16:
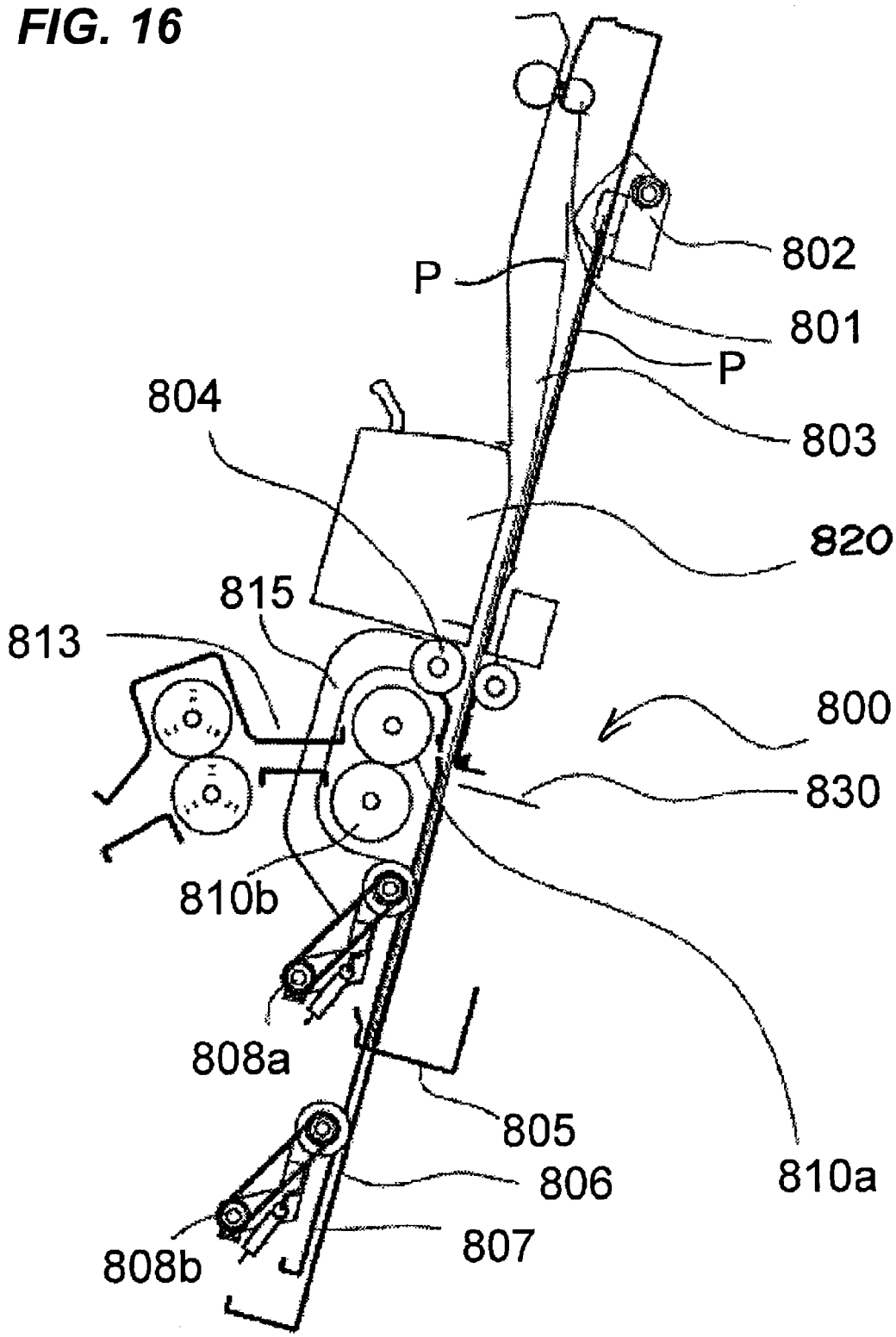
FIG. 16 illustrates the flow of the sheet in the saddle stitching bookbinding portion.
Figure 17:
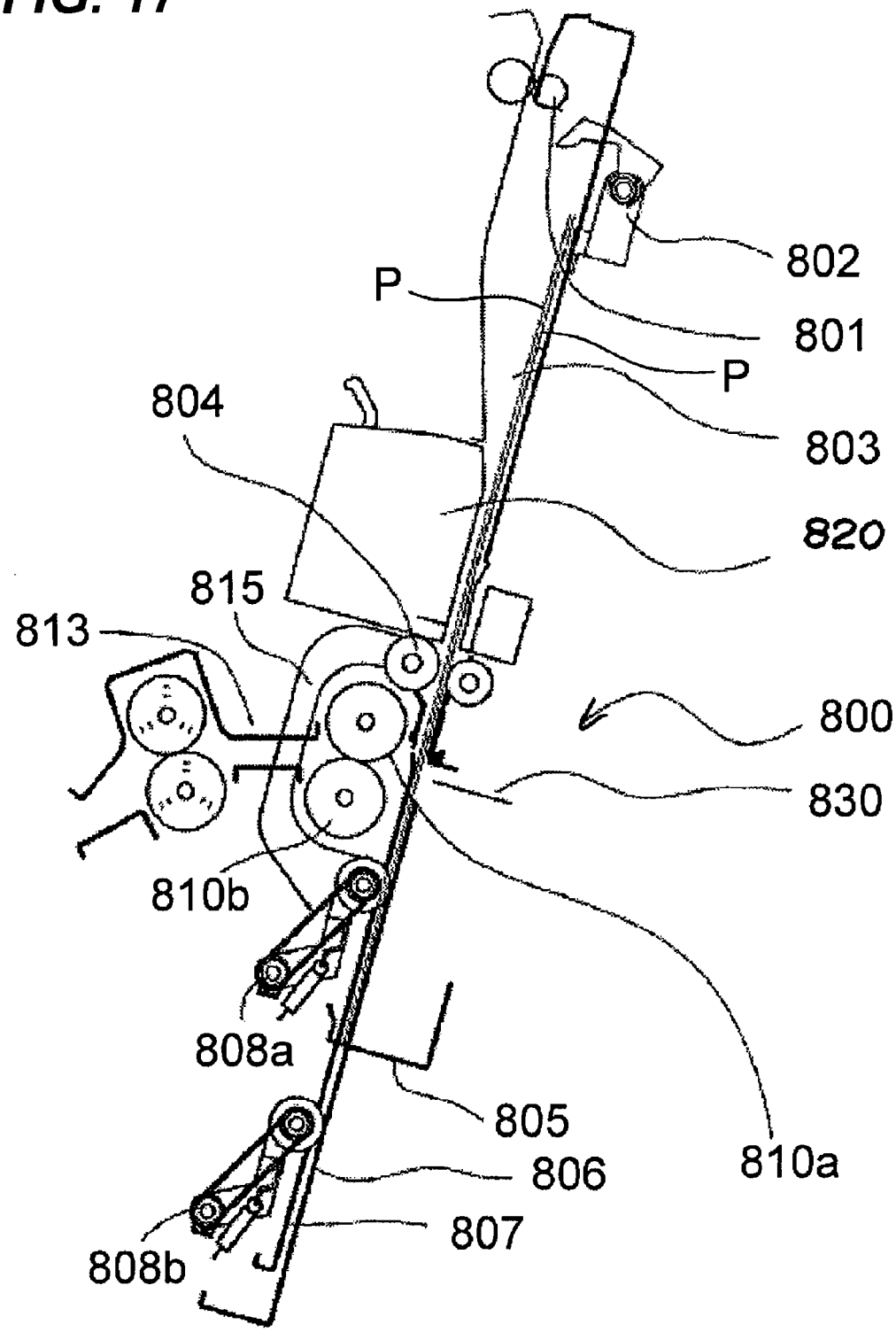
FIG. 17 illustrates the flow of the sheet in the saddle stitching bookbinding portion.

The alignment roller 808 is also moved to the position at which the alignment roller 808 contacts the sheet stack surface. When the next sheet P is abutted on the sheet positioning member 805 through the sheet trailing-end sorting member 802 as illustrated in FIG. 16, the clamping state of the sheet trailing-end sorting member 802 is released as illustrated in FIG. 17 (Step S12). Then, the separation of the alignment roller 808 and the alignment operation performed by the pair of alignment plates 815 are started.

The above-described sheet storage operation and alignment operation are performed every time the sheet P is delivered to the sheet storage guide 803. When the number of conveyed sheets P reaches a predetermined number (in the embodiment, five sheets P) (Step S10), the opening and closing shutter 807 is moved to widen the guide clearance (in the embodiment, every 1 mm) (Step S13).

Therefore, even if the sheet P is sequentially stacked to increase the thickness of the sheet bundle, the clearance between the sheet stack surface and the opening and closing shutter 807 is ensured, which allows the sheet P to pass through the clearance.

Figure 18:
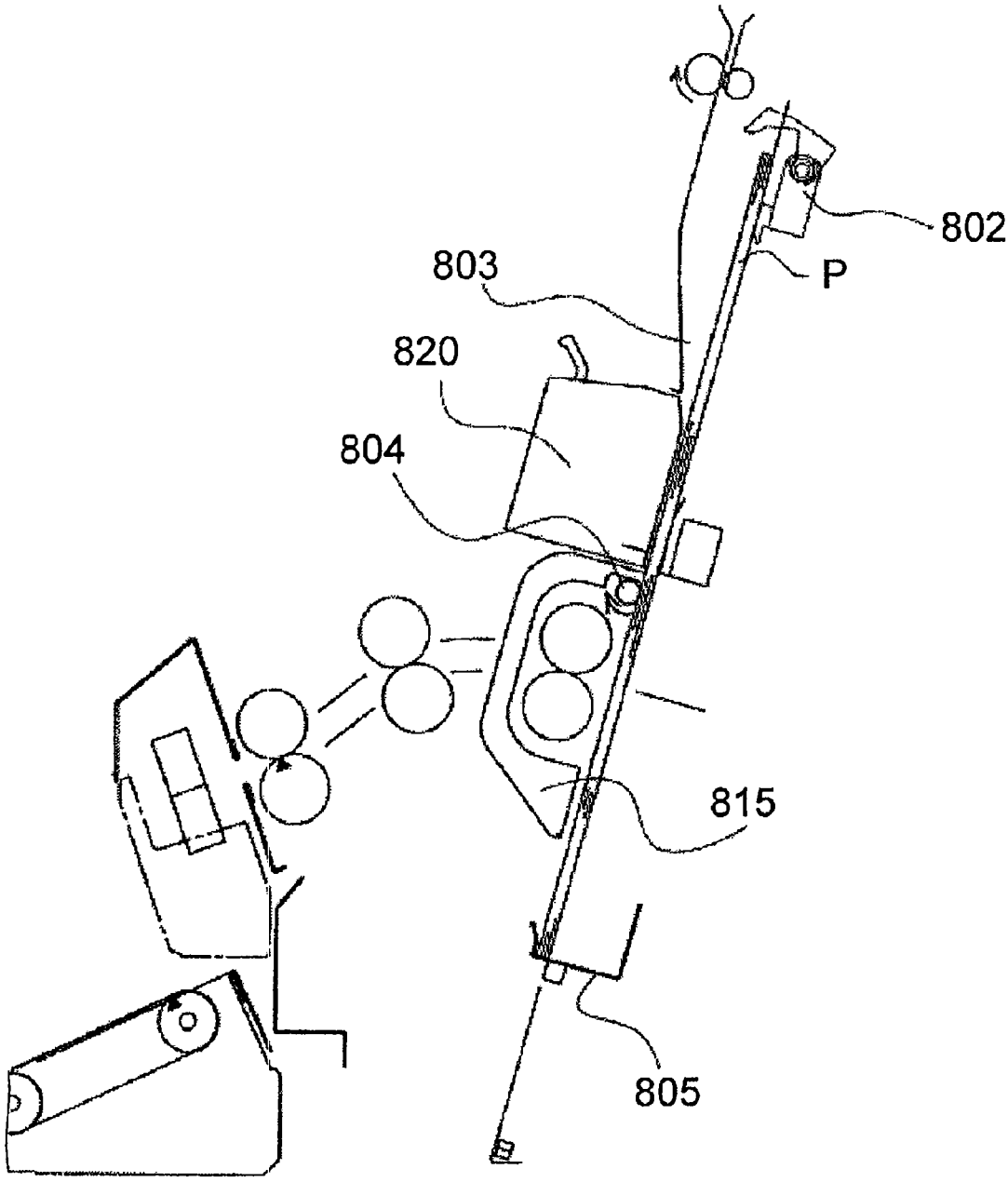
FIG. 18 illustrates the flow of the sheet in the saddle stitching bookbinding portion.
Figure 19:
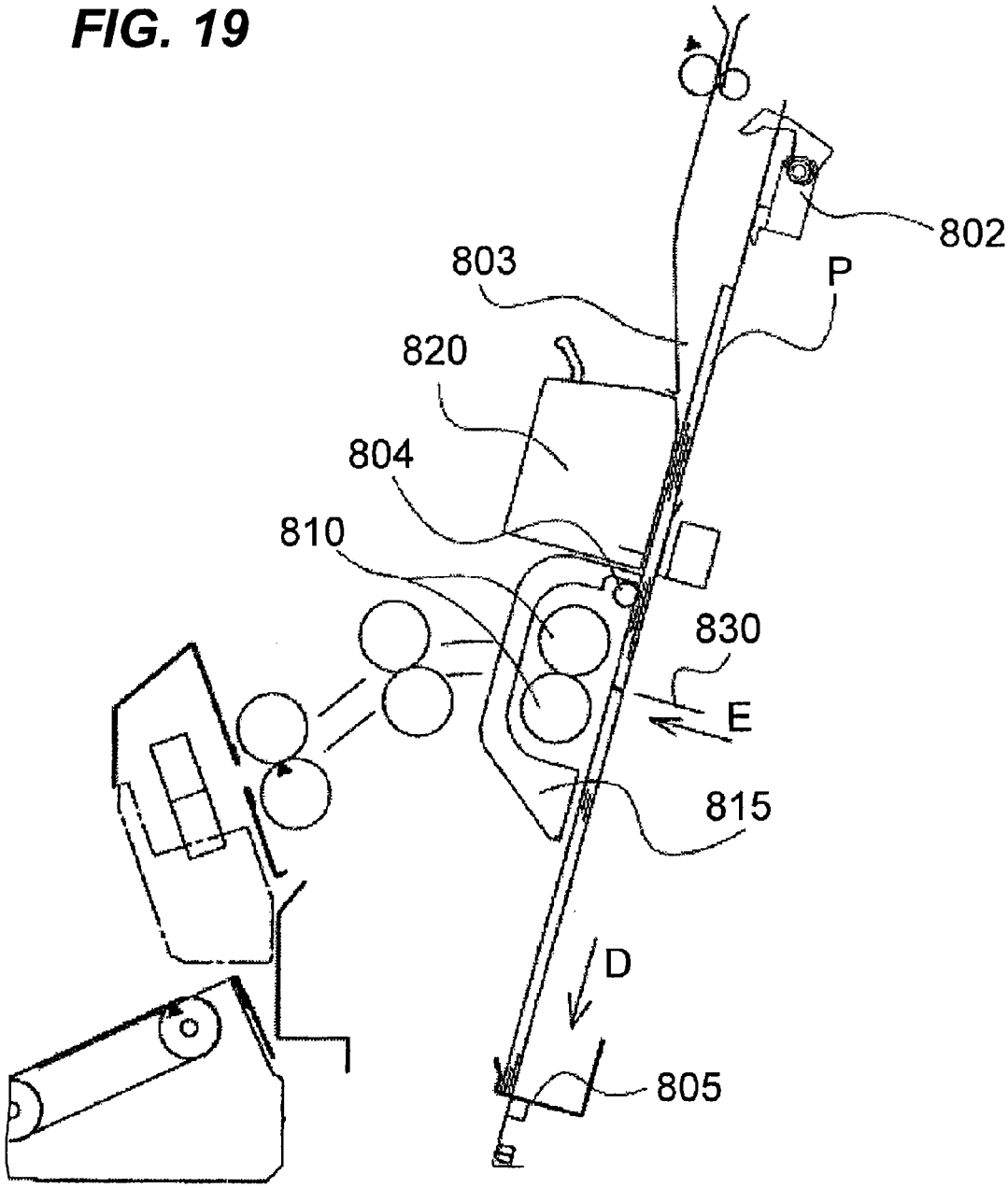
FIG. 19 illustrates the flow of the sheet in the saddle stitching bookbinding portion.

When the alignment of the final sheet P is ended (Step S14), as illustrated in FIG. 18, the sheet bundle clamped by the sheet trailing-end sorting member 802 is released (Step S15), and the stapler 820 staples the central portion in the sheet conveying direction of the sheet bundle stored in the sheet storage guide 803 (Step S16). As illustrated in FIG. 19, the stapled sheet bundle is moved downward (direction of an arrow D) as the sheet positioning member 805 is lowered.

The sheet positioning member 805 is stopped in the central portion of the sheet bundle, that is, at the position where the stapling portion faces the nip of the pair of folding rollers 810 (Steps S17 and S18). At the same time, the opening and closing shutter 807 is lowered (Step S19) to open the path between the ejection plate 830 and the pair of folding rollers 810*a* and 810*b*.

Then, the ejection plate 830 located at the waiting position is moved toward the nip of the pair of folding rollers 810 (toward a direction of an arrow E), and the ejection plate 830 tucks the central portion of the sheet bundle in the nip of the pair of folding rollers 810 while pushing and expanding the pair of folding rollers 810.

Figure 20:
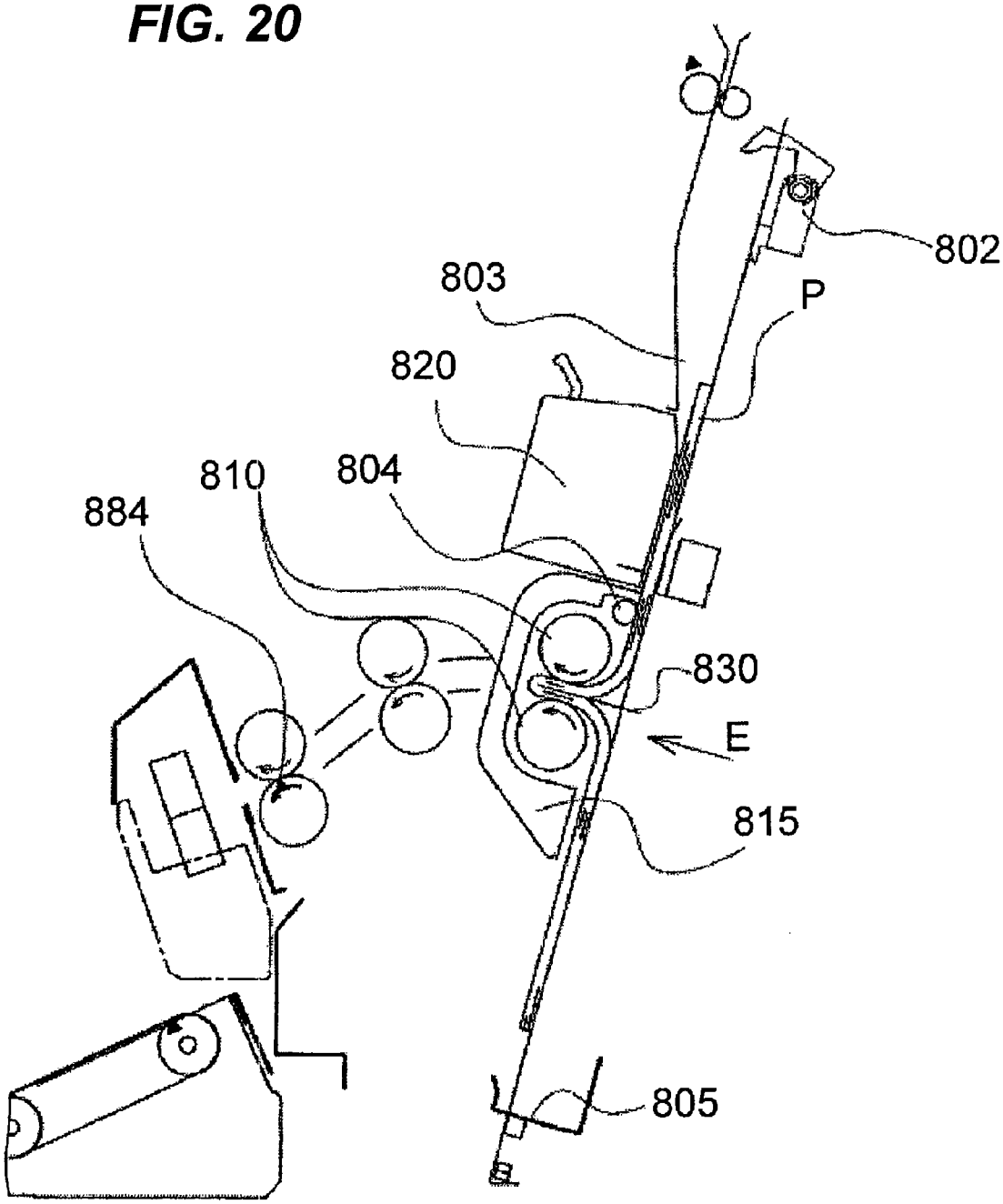
FIG. 20 illustrates the flow of the sheet in the saddle stitching bookbinding portion.

As illustrated in FIG. 20, the pair of folding rollers 810 is rotated while the sheet bundle is clamped by the nip, and the pair of folding rollers 810 conveys the sheet bundle to fold the sheet bundle into two (Step S20). At this point, the first pair of folding and conveying rollers 811 and the second pair of folding and conveying rollers 812 are rotated by the drive of the motor M4 in addition to the pair of folding rollers 810.

The pairs of rollers 810, 811, and 812 convey the folded sheet bundle while the folding portion of the folded sheet bundle is set to the leading portion. The folded sheet bundle is conveyed in the conveying guides 813 and 814.

Figure 21:
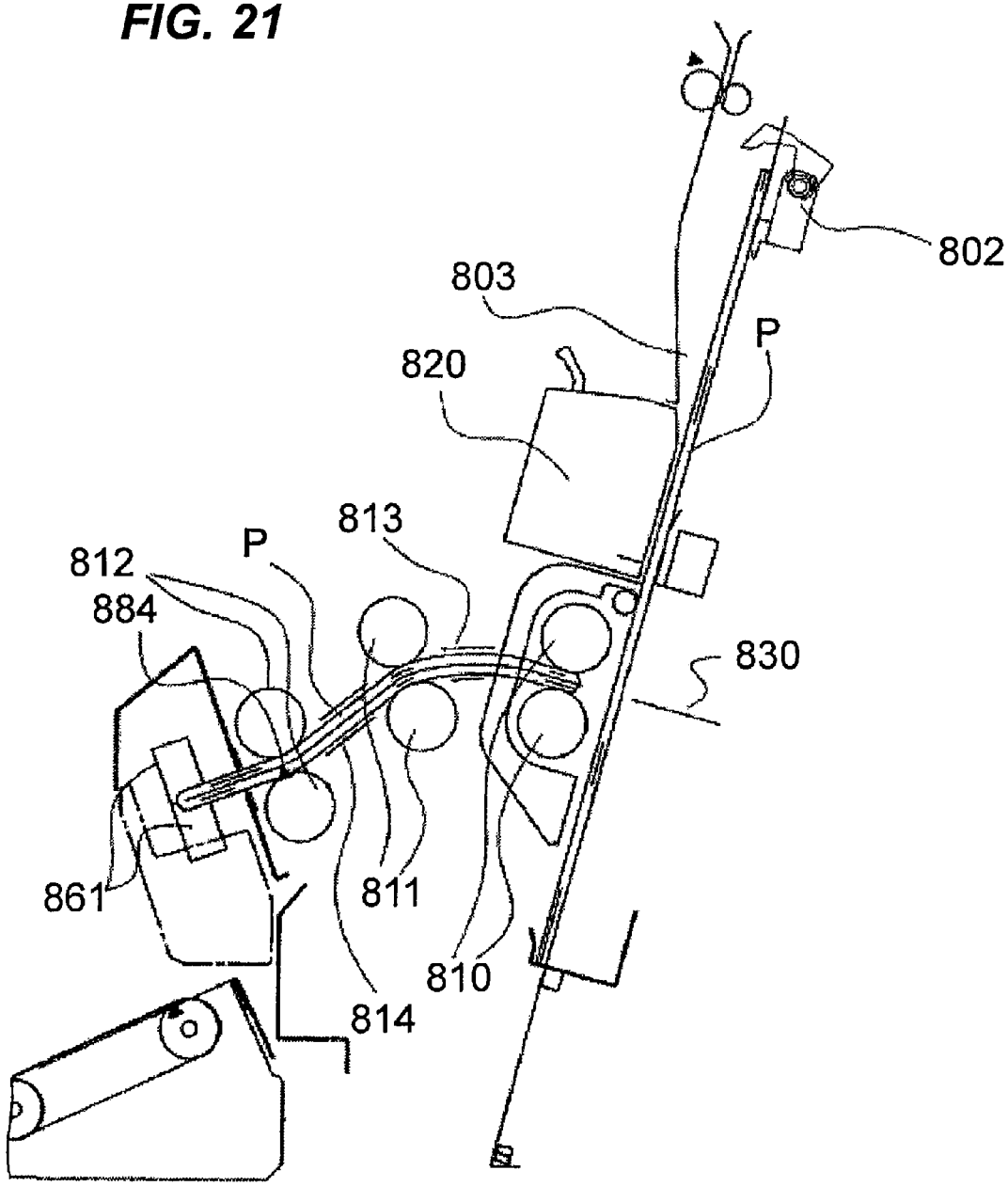
FIG. 21 illustrates the flow of the sheet in the saddle stitching bookbinding portion.
Figure 22:
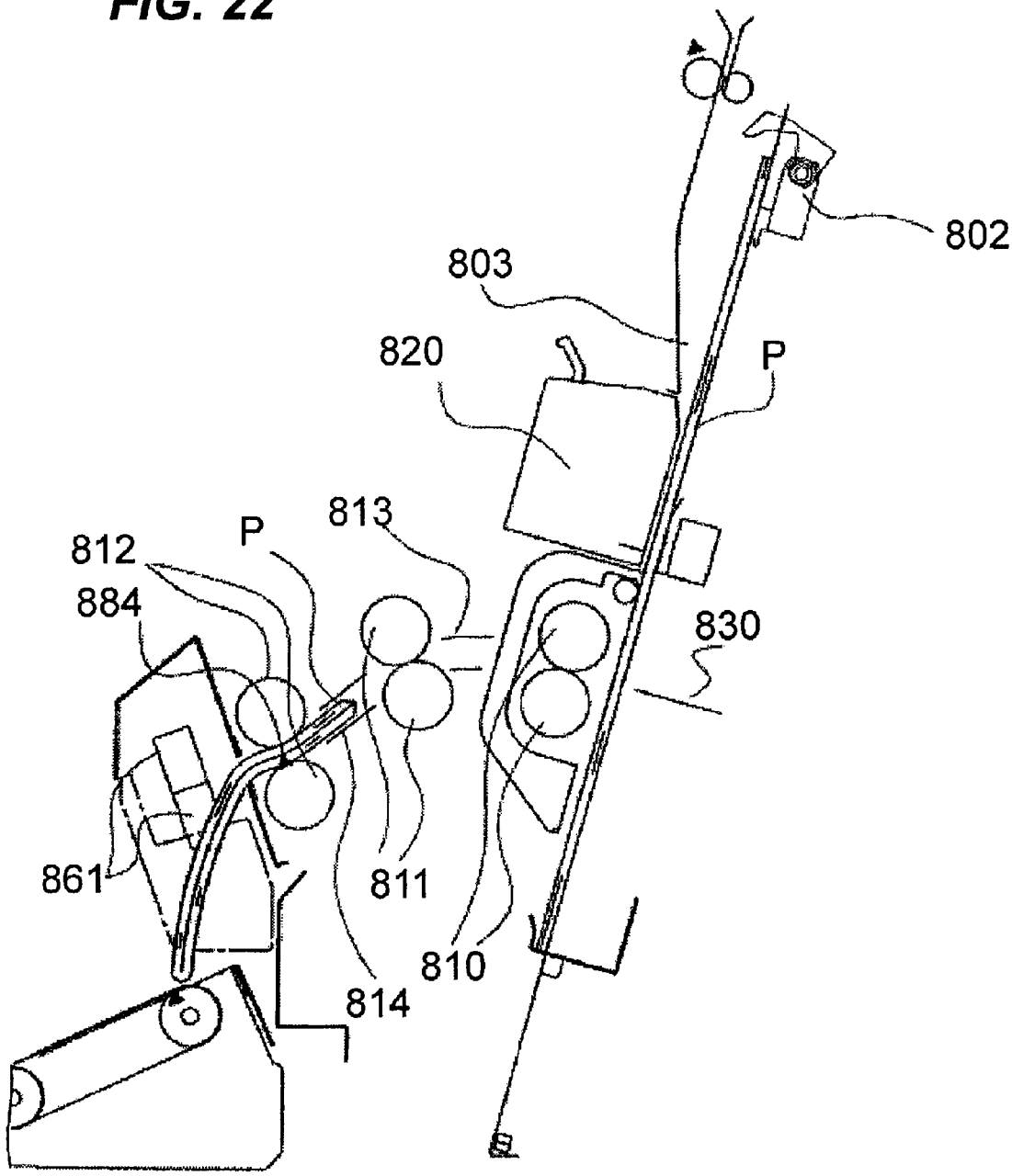
FIG. 22 illustrates the flow of the sheet in the saddle stitching bookbinding portion.
Figure 23:
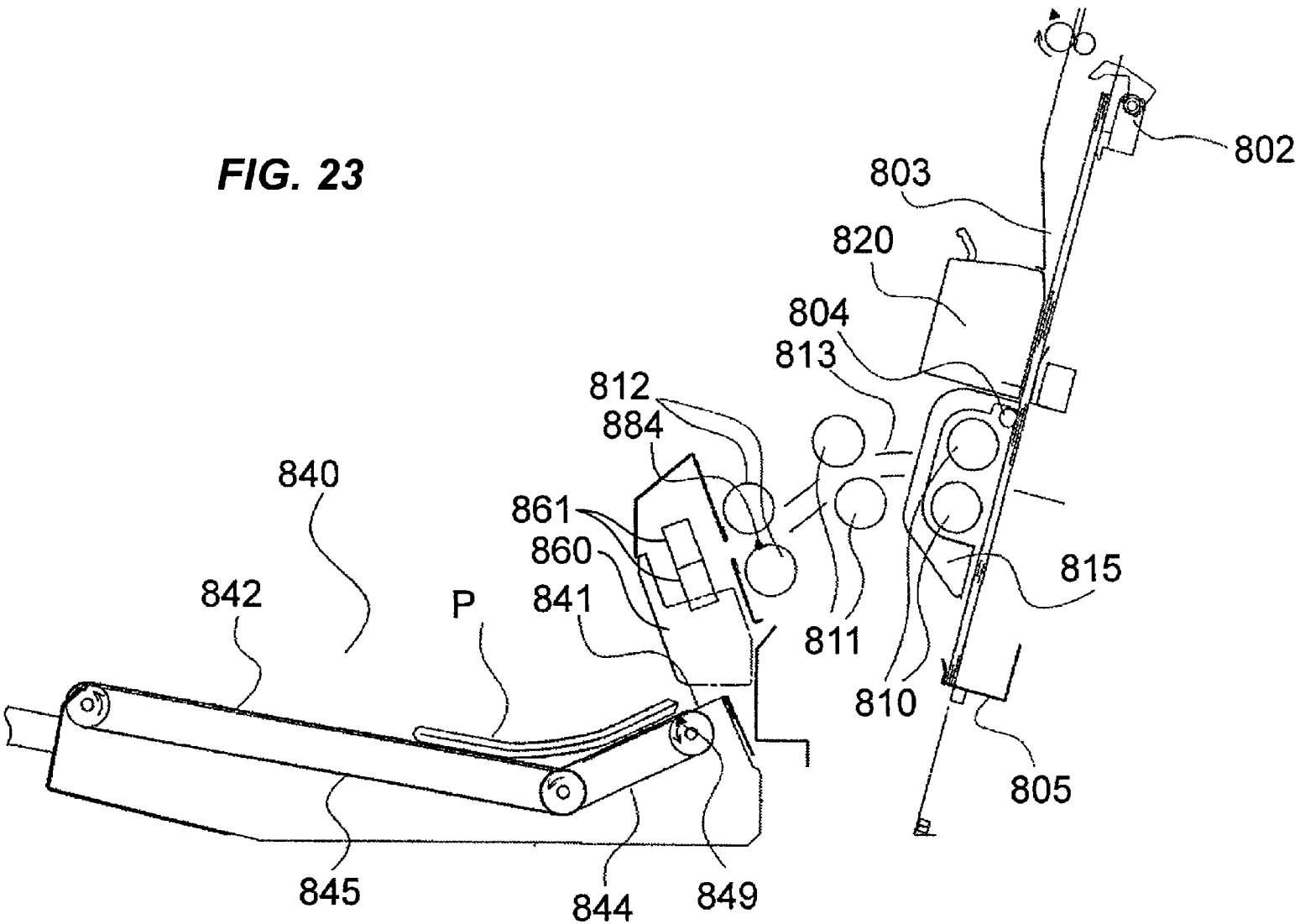
FIG. 23 illustrates the flow of the sheet in the saddle stitching bookbinding portion.

As illustrated in FIG. 21, when the folded sheet bundle is conveyed to the position at which the folded sheet bundle is nipped by the pair of press rollers 861, the folding portion is detected by a sensor 884, and the motor M4 is stopped to stop the conveyance. Then, the folded sheet bundle is nipped by the pair of press rollers 861 to make the folding line (Step S21), and the folded sheet bundle is discharged as illustrated in FIGS. 22 and 23 (Step S22). When the discharge of the final folded sheet bundle is ended, the job is finished (Steps S23 and S24).

<In the case of Thick Sheet>

Figure 13:
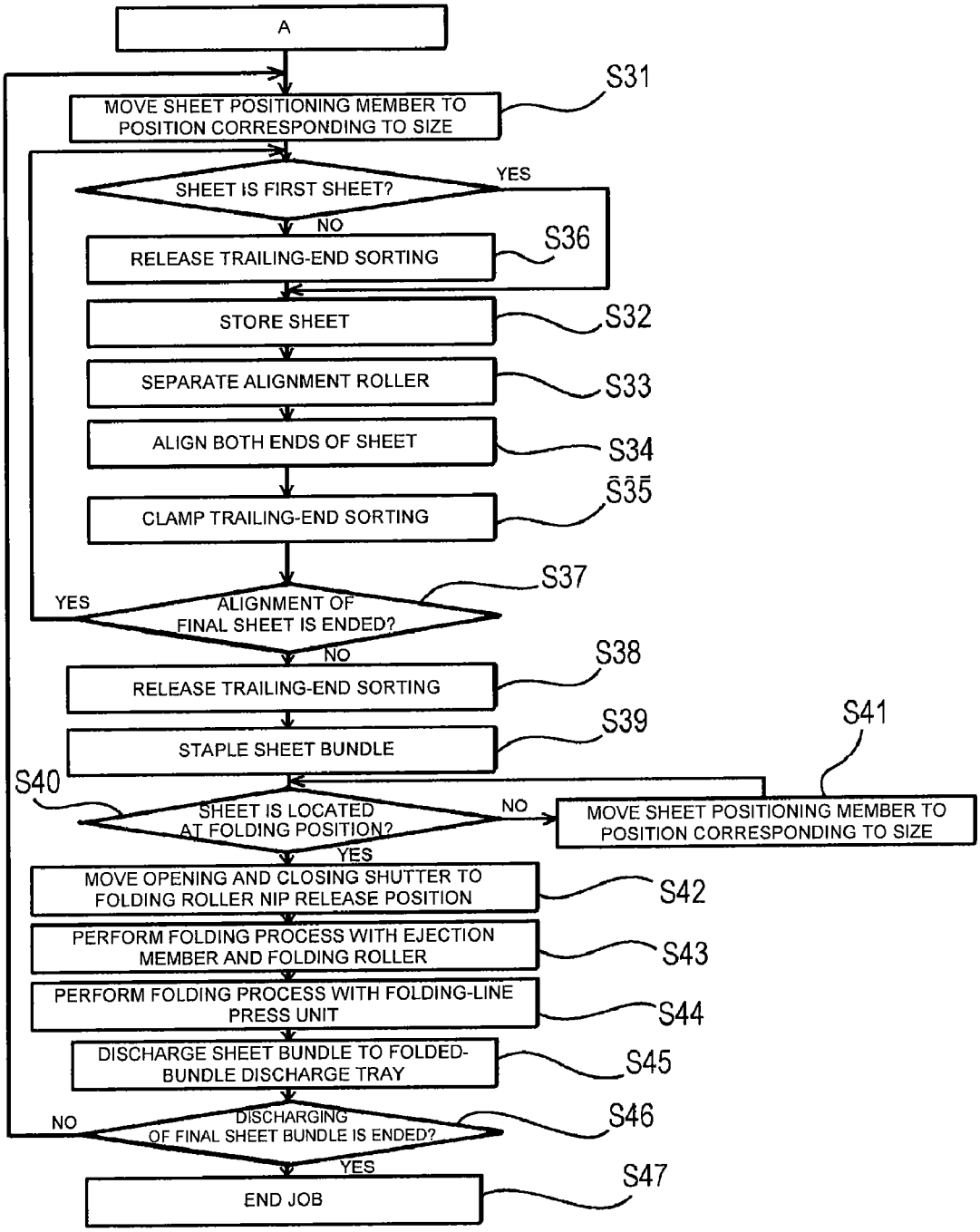
FIG. 13 illustrates a flowchart of the saddle stitching bookbinding operation performed by the saddle stitching bookbinding portion.

When the user sets a saddle stitching bookbinding mode in which the thick sheet is used (Steps S1 and S2) as illustrated in FIG. 12, similarly to the thin sheet, the sheet positioning member 805 is moved to the position corresponding to the set sheet size as illustrated in FIG. 13 (Step S31).

The opening and closing shutter 807 is moved to the position at which the sheet P is guided to the nip of the pair of folding rollers 810*a* and 810*b*. The sheet P in which the image is formed is sequentially discharged from the discharge roller 118 of the printer portion 300.

The sheet P passes through the folding processing portion 400 and the sheet P is received by the pair of entrance rollers 501. Then, the sheet P is delivered to the lower discharge path 522 through the conveying path 520. The sheet P in which the image is formed is sequentially discharged from the discharge roller 118 of the printer portion 300.

The sheet P passes through the folding processing portion 400 and the sheet P is received by the pair of entrance rollers 501. Then, the sheet P is delivered to the lower discharge path 522 through the conveying path 520. The sheet P is switched to the right by the switching member 514 provided in the middle of the lower discharge path 522, and the sheet P is delivered to the sheet saddle stitching bookbinding portion 800 through the saddle discharge path 523.

In FIG. 12, the sheet P is transferred to the pair of saddle entrance rollers 801 as a conveying portion, and the sheet P is brought in the sheet storage guide 803 of the saddle stitching bookbinding portion 800. The sheet P is abutted on the sheet positioning member 805 while conveying forces of the sliding roller 804 and alignment roller 808 are applied to the sheet P (Step S32). The sheet positioning member 805 is previously stopped at the position suitable to the sheet size in Step S31.

At this point, the opening and closing shutter 807 is located at the position where the conveyed sheet P is guided so as not to contact the pair of folding rollers 810*a* and 810*b*. In the case of the thick sheet in which the buckling is hardly generated, the guide clearance between the opening and closing shutter 807 and the sheet stack guide 806 is widened (for example, the guide clearance is set to 7 mm, see FIG. 6), and the space where the sheet P is conveyed and stacked is enlarged.

The alignment roller 808 is separated (Step S33), and the sheet P is sandwiched and aligned by the pair of alignment plates 815 which is retracted to the waiting position at which the pair of alignment plates 815 do not obstruct the sheet P in delivering the sheet P to the sheet storage guide 803, thereby aligning both side ends (width direction) of the sheet (Step S34).

Accordingly, as illustrated in FIG. 14, the lower end and both side ends are aligned in the sheet P. As illustrated in FIG. 15, the sheet trailing-end sorting member 802 which is of the holding member clamps the sheet trailing end (Step S35), thereby fixing the sheet position. Then, the pair of alignment plates 815 and the opening and closing shutter 807 wait for the conveyance of the next sheet P.

The alignment roller 808 is also moved to the position at which the alignment roller 808 contacts the sheet stack surface. When the next sheet P is abutted on the sheet positioning member 805 through the sheet trailing-end sorting member 802 as illustrated in FIG. 16, the clamping state of the sheet trailing-end sorting member 802 is released as illustrated in FIG. 17 (Step S36).

Then, the separation of the alignment roller 808 and the alignment operation performed by the pair of alignment plates 815 are started.

As described above, because the buckling of the thick sheet P is hardly generated unlike the thin sheet, the opening and closing shutter 807 is not moved to narrow the guide clearance, nor performed the pressing operation, thereby saving the power consumption.

The above-described sheet storage operation and alignment operation are performed every time the sheet P is delivered to the sheet storage guide 803. When the alignment of the final sheet P is ended (Step S37), as illustrated in FIG. 18, the sheet bundle clamped by the sheet trailing-end sorting member 802 is released (Step S38), and the stapler 820 staples the central portion in the sheet conveying direction of the sheet bundle stored in the sheet storage guide 803 (Step S39). As illustrated in FIG. 19, the stapled sheet bundle is moved downward (direction of the arrow D) as the sheet positioning member 805 is lowered.

The sheet positioning member 805 is stopped in the central portion of the sheet bundle, that is, at the position where the stapling portion faces the nip of the pair of folding rollers 810 (Steps S40 and S41). At the same time, the opening and closing shutter 807 is lowered (Step S42) to open the path between the ejection plate 830 and the pair of folding rollers 810*a* and 810*b*.

Then, the ejection plate 830 located at the waiting position is moved toward the nip of the pair of folding rollers 810 (toward a direction of the arrow E), and the ejection plate 830 tucks the central portion of the sheet bundle in the nip of the pair of folding rollers 810 while pushing and expanding the pair of folding rollers 810.

As illustrated in FIG. 20, the pair of folding rollers 810 is rotated while the sheet bundle is nipped by the nip, and the pair of folding rollers 810 conveys the sheet bundle to fold the sheet bundle into two (Step S43). At this point, the first pair of folding and conveying rollers 811 and the second pair of folding and conveying rollers 812 are rotated by the drive of the motor M4 in addition to the pair of folding rollers 810.

The pairs of rollers 810, 811, and 812 convey the folded sheet bundle while the folding portion of the folded sheet bundle is set to the leading portion. The folded sheet bundle is conveyed in the conveying guides 813 and 814.

As illustrated in FIG. 21, when the folded sheet bundle is conveyed to the position at which the folded sheet bundle is nipped by the pair of press rollers 861, the folding portion is detected by the sensor 884, and the motor M4 is stopped to stop the conveyance. Then, the folded sheet bundle is nipped by the pair of press rollers 861 to make the folding line (Step S44), and the folded sheet bundle is discharged as illustrated in FIGS. 22 and 23 (Step S45). When the discharge of the final folded sheet bundle is ended, the job is finished (Steps S46 and S47).

In the embodiment, the sheet guide clearance can be changed on the upstream and downstream sides of the conveying roller and near the sheet positioning member 805. Therefore, the sheet guide clearance is narrowed to securely prevent the buckling even in the poor fragile sheet P.

The sheet bundle is widely pressed, so that the air between the sheets P can be removed to prevent the wave of the sheet bundle. The sheet guide clearance is opened after the trailing end of the sheet P is held, so that the buckling caused by the self weight of the sheet P can be prevented to improve the alignment performance and the conveying performance.

Although the embodiment of the invention is described above in detail, the invention is not limited to the embodiment, but various changes and modifications can be made without departing from the scope of claims of the invention.

For example, although the saddle stitching bookbinding portion 800 which is of the sheet stacking apparatus is integrated with the finisher 500 in the embodiment, the same effect is obtained even if the saddle stitching bookbinding portion 800 is incorporated in the image forming apparatus main body.

In the embodiment, when the thick sheet is set, the opening and closing shutter 807 is moved to narrow the guide clearance, and the pressing operation is not performed. Alternatively, the guide clearance Ly of FIG. 7 may be set to a value for the thick sheet (for example, Ly=3 mm).

The guide clearance Ly may be set to a value for the thick sheet such that the opening and closing shutter 807 is moved to widen the guide clearance (for example, each 2 mm) every time the number of conveyed sheets P reaches a predetermined number (for example, three sheets P). Additionally, the pressing operation of the opening and closing shutter 807 may be added. The pressing operation can be set at proper control according to the kind of the sheet P.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-306541, filed Nov. 27, 2007, which is hereby incorporated by reference herein in its entirety.

What is claimed is:

1. A sheet processing apparatus comprising:

a sheet stack tray which provides an inclined sheet stack surface on which a sheet is stacked;

a regulating member, having a regulating surface disposed opposite the inclined sheet stack surface, which is movable toward the inclined sheet stack surface so as to decrease a clearance between the regulating surface and the inclined sheet stack surface, and thereby regulate the sheet stacked on the inclined sheet stack surface;

a clamping member which clamps an upper portion of the sheet stacked on the inclined sheet stack surface;

a pair of folding rollers which performs a folding process to the sheet stacked on the sheet stack tray, the pair of folding rollers being disposed on a side to which the pair of folding rollers faces the inclined sheet stack surface at a predetermined distance from the inclined sheet stack surface; and a controller which controls movement of the clamping member and movement of the regulating member so that, the clamping member clamps the upper portions of the sheet after the regulating member regulates the sheet, and the regulating member moves to increase the clearance between the regulating surface and the inclined sheet stack surface while the upper portion of the sheet is clamped by the clamping member.

2. The sheet processing apparatus according to claim 1, wherein the regulating member is movable parallel to a plane of the inclined sheet stack surface, and the regulating member is moved to a guide position at which the sheet to be stacked is guided so as not to contact the pair of folding rollers.

3. The sheet processing apparatus according to claim 2, wherein a single drive source drives the regulating member when the regulating member is moved to the guide position and in a sheet thickness direction.

4. The sheet processing apparatus according to claim 2, wherein the regulating member is movable between the guide position and a position at which the sheet is enabled to be conveyed to the pair of folding rollers, and the regulating member is movable in a sheet thickness direction at the guide position.

5. The sheet processing apparatus according to claim 1, wherein the interval between the regulating surface and the inclined sheet stack surface is changed according to a thickness of the stacked sheet when the sheet is stacked on the sheet stack tray.

6. The sheet processing apparatus according to claim 1, wherein the interval between the regulating surface and the inclined sheet stack surface is changed according to the number of stacked sheets when the sheets are stacked on the sheet stack tray.

7. The sheet processing apparatus according to claim 1, comprising an abutment member against which a lower end of the sheet stacked on the sheet stack tray is abutted, the abutment member is provided at a lower portion of the sheet stack tray.

8. An image forming apparatus comprising:

an image forming portion which forms an image in a sheet; and a sheet processing apparatus which processes the sheet, wherein the sheet processing apparatus includes:

a sheet stack tray which provides an inclined sheet stack surface on which the image formed sheet is stacked;

a regulating member, having a regulating surface disposed opposite the inclined sheet stack surface, which is movable toward the inclined sheet stack surface so as to decrease a clearance between the regulating surface and the inclined sheet stack surface, and thereby regulate the sheet stacked on the inclined sheet stack surface;

a clamping member which clamps an upper portion of the sheet stacked on the inclined sheet stack surface;

a pair of folding rollers which performs a folding process to the sheet stacked on the sheet stack tray, the pair of folding rollers being disposed on a side to which the pair of folding rollers faces the inclined sheet stack surface at a predetermined distance from the inclined sheet stack surface; and a controller which controls movement of the clamping member and movement of the regulating member so that, the clamping member clamps the upper portion of the sheet after the regulating member regulates the sheet, and the regulating member moves to increase the clearance between the regulating surface and the inclined sheet stack surface while the upper portion of the sheet is clamped by the clamping member.

9. The image forming apparatus according to claim 8, wherein the interval between the regulating surface and the inclined sheet stack surface is changed according to a thickness of the stacked sheet when the sheet is stacked on the sheet stack tray.

10. The image forming apparatus according to claim 8, wherein the interval between the regulating surface and the inclined sheet stack surface is changed according to the number of stacked sheets when the sheets are stacked on the sheet stack tray.

11. The image forming apparatus according to claim 8, comprising an abutment member against which a lower end of the sheet stacked on the sheet stack tray is abutted, the abutment member is provided at a lower portion of the sheet stack tray.

12. The image forming apparatus according to claim 8, wherein the regulating member is movable parallel to a plane of the inclined sheet stack surface, and the regulating member is moved to a guide position at which the sheet to be stacked is guided so as not to contact the pair of folding rollers.

13. The image forming apparatus according to claim 12, wherein a single drive source drives the regulating member when the regulating member is moved to the guide position and in a sheet thickness direction.

14. The sheet processing apparatus according to claim 12, wherein the regulating member is movable between the guide position and a position at which the sheet is enabled to be conveyed to the pair of folding rollers, and the regulating member is movable in a sheet thickness direction at the guide position.

* * * * *